US006602386B1

(12) United States Patent
Takeuchi et al.

(10) Patent No.: US 6,602,386 B1
(45) Date of Patent: Aug. 5, 2003

(54) FIBRILLATED RAYON-CONTAINING, WATER-DECOMPOSABLE FIBROUS SHEET

(75) Inventors: Naohito Takeuchi, Kagawa (JP); Jyoji Shimizu, Kagawa (JP); Kazuya Okada, Kagawa (JP); Toshiyuki Tanio, Kagawa (JP); Takayoshi Konishi, Kagawa (JP)

(73) Assignee: Uni-Charm Corporation, Kawanoe (JP)

( * ) Notice: Subject to any disclaimer, the term of this patent is extended or adjusted under 35 U.S.C. 154(b) by 0 days.

(21) Appl. No.: 09/491,621

(22) Filed: Jan. 26, 2000

(30) Foreign Application Priority Data

Jan. 29, 1999 (JP) ..... 11-022016
Oct. 6, 1999 (JP) ..... 11-285655
Jan. 21, 2000 (JP) ..... 2000-012658

(51) Int. Cl.[7] ..... D21F 11/00; D21F 13/00; D04H 1/56

(52) U.S. Cl. ..... 162/115; 162/146; 162/157.6; 442/408

(58) Field of Search ..... 442/408; 162/115, 162/141, 146, 149, 157.7, 157.6

(56) References Cited

U.S. PATENT DOCUMENTS 3,563,241 A 2/1971 Evans ..... 128/284
3,785,918 A 1/1974 Kawai ..... 169/169

FOREIGN PATENT DOCUMENTS

| | | |
|---|---|---|
| FR | 1423789 | 11/1964 |
| GB | 687041 | 2/1953 |
| JP | 3292924 | 12/1991 |
| JP | 525764 | 2/1993 |
| JP | 5179548 | 7/1993 |
| JP | 6198778 | 7/1994 |
| JP | 724636 | 3/1995 |
| JP | 2501534 | 3/1996 |
| JP | 2549159 | 8/1996 |
| JP | 2584508 | 11/1996 |
| JP | 978419 | 3/1997 |
| JP | 9228214 | 9/1997 |
| JP | 1028702 | 2/1998 |
| JP | 10140494 | 5/1998 |
| JP | 10310960 | 11/1998 |
| JP | 1143854 | 2/1999 |

OTHER PUBLICATIONS

Merkel, Robert S., Tortora, Phyllis G. Fairchild's Dictionary of Textiles 7th Edition. Fairchild Publications. NeywYork. 1996. p. 462.*

Functional Paper Association Journal No. 36, Nov. 1997, Solvent Spun Cellulose Fiber "Courtaulds Lyocell", Kunihiko Tozaki.

* cited by examiner

*Primary Examiner*—Terrel Morris
*Assistant Examiner*—Jenna-Leigh Befumo
(74) *Attorney, Agent, or Firm*—Darby & Darby

(57) ABSTRACT

Conventional water-decomposable fibrous sheets for cleaning sheets capable of being disposed of in toilets and others do not have well-balanced decomposability in water and strength. The water-decomposable fibrous sheet containing from 5 to 100% by mass of fibrillated rayon having a fiber length of at most 10 mm and having a degree of beating of at most 700 cc, optionally along with other fibers having a length of at most 10 mm, has good decomposability in water and high wet strength. When subjected to water-jetting treatment, it becomes more bulky to have a soft feel.

13 Claims, 8 Drawing Sheets

745cc
464cc
337cc
203cc
96cc
% BY MASS
30
25
20
15
10
5
0
0.0-0.2
0.4-0.6
0.8-1.0
1.2-1.4
1.6-1.8
2.0-2.2
2.4-2.6
2.8-3.0
3.2-3.4
3.6- 3.8
4.0-4.2
4.4-4.6
4.8-5.0
5.2-5.4
5.6-5.8
6.0-6.2
6.4-6.6
6.8-7.00
FIBER LENGTH RANGE (mm-mm)

745cc
615cc
445cc
353cc
227cc
147cc
% BY MASS
20
18
16
14
12
10
8
6
4
2
0
0.0-0.2
0.4-0.6
0.8-1.0
1.2-1.4
1.6-1.8
2.0-2.2
2.4-2.6
2.8-3.0
3.2-3.4
3.6- 3.8
4.0-4.2
4.4-4.6
4.8-5.0
5.2-5.4
5.6-5.8
6.0-6.2
6.4-6.6
6.8-7.00
FIBER LENGTH RANGE (mm-mm)

FIBRILLATED RAYON-CONTAINING, WATER-DECOMPOSABLE FIBROUS SHEET

BACKGROUND OF THE INVENTION

1. Field of the Invention

The present invention relates to a water-decomposable fibrous sheet capable of being readily decomposed and dispersed in water flow. More precisely, it relates to a water-decomposable fibrous sheet having high strength in dry and wet but capable of being readily decomposed in water.

2. Description of the Related Art

To wipe the skin of human bodies including the private parts thereof, or to clean toilets and thereabouts, used are cleaning sheets made of paper or non-woven fabric. The cleaning sheets must be decomposable in water so that they could be directly disposed of in toilets after their use. This is because, if hardly water-decomposable cleaning sheets are disposed of in toilets after their use, they will take a lot of time until they are decomposed and dispersed in septic tanks, or will clog the drainpipes around toilets.

For easy and effective use, many disposable cleaning sheets for wiper applications are packaged while being wetted with a detergent chemical or the like, and are put on the market. Such cleaning sheets must have high strength in wet to such a degree that they are well fit for wiping with them containing a detergent chemical or the like, but must well decompose in water after they are disposed of in toilets.

For example, Japanese Patent Publication No. 24636/1995 discloses a water-decomposable cleaning article that comprises a carboxyl group-having, water-soluble binder, a metal ion and an organic solvent. However, the metal ion and the organic solvent irritate the skin.

Japanese Patent Laid-Open No. 292924/1991 discloses a water-decomposable cleaning article of polyvinyl alcohol-containing fibers with an aqueous solution of boric acid infiltrated thereinto; and Japanese Patent Laid-Open No. 198778/1994 discloses a water-decomposable napkin of polyvinyl alcohol-containing non-woven fabric with a borate ion and a bicarbonate ion introduced thereinto. However, polyvinyl alcohol is not resistant to heat, and therefore the wet strength of the water-decomposable cleaning article and the water-decomposable napkin is lowered at 40° C. or higher. Recently, various water-decomposable absorbent articles including sanitary napkins, panty liners, disposable diapers and others have been investigated in the art. In view of their safety, however, the water-decomposable fibrous sheets mentioned above could not be used as the top sheets for those absorbent articles that shall be kept in direct contact with the skin for a long period of time, as they contain a binder and an electrolyte.

On the other hand, Japanese Patent Laid-Open No. 228214/1997 discloses a water-degradable non-woven fabric having a wet strength of from 100 to 800 gf/25 mm as measured according to JIS P-8135, which is produced by mixing fibers having a length of from 4 to 20 mm with pulp followed by entangling them through treatment with high-pressure water jets. Since the constituent fibers are entangled in it, the non-woven fabric disclosed has a bulky feel. However, in producing the non-woven fabric, long fibers are entangled through high-pressure water jet treatment, whereby the non-woven fabric produced could have such a relatively high wet strength. Therefore, according to the technique disclosed, it is difficult to realize well-balanced bulkiness, strength and water-degradability for the non-woven fabric produced, and the non-woven fabric produced is unsuitable to disposal in flush toilets, etc.

SUMMARY OF THE INVENTION

The present invention is to solve the problems in the prior art noted above, and its one object is to provide a water-decomposable fibrous sheet which is well decomposed in water and has high dry strength.

Another object of the invention is to provide a water-decomposable fibrous sheet which has high wet strength to such a degree that it is well usable in wet even though no binder is added thereto.

Still another object of the invention is to provide a water-decomposable fibrous sheet which is safe for its application to the skin.

Specifically, the invention is to provide a water-decomposable fibrous sheet, which comprises from 3% by mass to 100% by mass of fibrillated rayon comprising primary fibers and microfibers extending therefrom, and from 0% by mass to 97% by mass of other fibers having a length of at most 10 mm, and in which the fibrillated rayon has a degree of beating of at most 700 cc; the primary fibers have a length in a range of from 1.8 mm to 10 mm at a peak of mass distribution thereof; and at least the microfibers extending from the primary fibers of the fibrillated rayon are entangled with at least one of other primary fibers, other microfibers extending from the other primary fibers and the other fibers.

The invention is also to provide a water-decomposable fibrous sheet, which comprises from 3% by mass to 100% by mass of fibrillated rayon comprising primary fibers and microfibers extending therefrom, and from 0% by mass to 97% by mass of other fibers having a length of at most 10 mm, and in which the primary fibers have a length in a range of from 1.8 mm to 10 mm at a peak of mass distribution thereof, the microfibers having a length of at most 1 mm account for from 0.1 to 65% by mass of the self-weight of the fibrillated rayon; and at least the microfibers extending from the primary fibers of the fibrillated rayon are entangled with at least one of other primary fibers, other microfibers extending from the other primary fibers and the other fibers.

The water-decomposable fibrous sheets described above are preferably non-woven fabrics subjected to water jetting treatment.

Also, the invention is to provide a water-decomposable fibrous sheet, which comprises from 3% by mass to 100% by mass of fibrillated rayon comprising primary fibers and microfibers extending therefrom, and from 0% by mass to 97% by mass of other fibers having a length of at most 10 mm, and in which the fibrillated rayon has a degree of beating of at most 700 cc; the primary fibers have a length in a range of from 1.8 mm to 10 mm at a peak of mass distribution thereof; and at least the microfibers extending from the primary fibers of the fibrillated rayon are hydrogen bonded with at least one of other primary fibers, other microfibers extending from the other primary fibers and the other fibers.

The invention is also to provide a water-decomposable fibrous sheet, which comprises from 3% by mass to 100% by mass of fibrillated rayon comprising primary fibers and microfibers extending therefrom, and from 0% by mass to 97% by mass of other fibers having a length of at most 10 mm, and in which the primary fibers have a length in a range of from 1.8 mm to 10 mm at a peak of mass distribution thereof; the microfibers having a length of at most 1 mm account for from 0.1 to 65% by mass of the self-weight of the fibrillated rayon; and at least the microfibers extending from the primary fibers of the fibrillated rayon are hydrogen bonded with at least one of other primary fibers, other microfibers extending from the other primary fibers and the other fibers.

The water-decomposable fibrous sheets described above are preferably produced in a paper-making process. In this case, preferably, the fibrillated rayon has a degree of beating of at most 400 cc.

Naturally in dry and even in wet with water, the water-decomposable fibrous sheet of the invention all the time keeps high strength while it is used as a wiper. In addition, when it is immersed in a large amount of water after used, it is readily decomposed. Therefore, after used, it can be disposed of in toilets, etc. What is more, the water-decomposable fibrous sheet of the invention is composed of materials not harmful to human bodies.

More specifically, in the water-decomposable fibrous sheet of the invention, because the microfibers of the fibrillated rayon act to bind the fibers together, well balanced decomposability in water and strength are realized. With the microfibers entangled with or hydrogen bonded with other fibers, the fibrous sheet procures high strength. On the other hand, when kept in contact with a large amount of water, the microfibers are separated from the other fibers, and therefore, the fibrous sheet is readily decomposed in water. In particular, when the microfibers extending from the primary fibers of the fibrillated rayon are entangled with at least one of other primary fibers, other microfibers extending from the other primary fibers and the other fibers through the water jetting treatment, the fibers are strongly bound together, and moreover, the dry strength of the sheet is increased owing to the hydrogen bonding power of the microfibers. Such hydrogen bonding may sometimes be canceled in a wet condition, but the sheet can maintain high strength even in wet because of the entanglement of the microfibers.

On the other hand, when the water-decomposable fibrous sheet of the invention is produced for example in a paper-making process i.e., produced without subjecting it to water jetting treatment, the fibrous sheet has high strength owing to the presence of the microfibers. The microfibers can exhibit the hydrogen bonding power as much as, or more than pulp, and therefore, the fibrous sheet has well balanced decomposability in water and strength. The fibrous sheet thus produced in a paper-making process will be excellent in strength upon use in a dry condition. Even in such sheet, additionally, the wet strength could be increased owing to the entanglement of the microfibers.

In the invention, where the primary fibers have a length of from 2.5 mm to less than 4.5 mm at a peak of mass distribution thereof and the fibrillated rayon has a degree of beating of smaller than 400 cc, it is desirable that the microfibers having a length of at most 1 mm account for from 0.5 to 15% by mass of the self-weight of the fibrillated rayon.

Where the primary fibers have a length of from 2.5 mm to less than 4.5 mm at a peak of mass distribution thereof and the fibrillated rayon has a degree of beating of from 400 cc to 700 cc, it is desirable that the microfibers having a length of at most 1 mm account for from 0.1 to 5% by mass of the self-weight of the fibrillated rayon.

Where the primary fibers have a length of from 4.5 mm to 7.5 mm at a peak of mass distribution thereof and the fibrillated rayon has a degree of beating of smaller than 400 cc, it is desirable that the microfibers having a length of at most 1 mm account for from 8 to 65% by mass of the self-weight of the fibrillated rayon.

Where the primary fibers have a length of from 4.5 mm to 7.5 mm at a peak of mass distribution thereof and the fibrillated rayon has a degree of beating of from 400 cc to 700 cc, it is desirable that the microfibers having a length of at most 1 mm account for from 0.3 to 50% by mass of the self-weight of the fibrillated rayon.

Where the primary fibers have a length of 3 i 0.5 mm at a peak of mass distribution thereof, it is desirable that the microfibers having a length of at most 1 mm account for from 0.1 to 10% by mass of the self-weight of the fibrillated rayon.

Where the primary fibers have a length of 4±0.5 mm at a peak of mass distribution thereof, it is desirable that the microfibers having a length of at most 1 mm account for from 1 to 14% by mass of the self-weight of the fibrillated rayon.

Where the primary fibers have a length of 5±0.5 mm at a peak of mass distribution thereof, it is desirable that the microfibers having a length of at most 1 mm account for from 0.3 to 45% by mass of the self-weight of the fibrillated rayon.

Where the primary fibers have a length of 6±0.5 mm at a peak of mass distribution thereof, it is desirable that the microfibers having a length of at most 1 mm account for from 5 to 50% by mass of the self-weight of the fibrillated rayon.

Where the primary fibers have a length of 7±0.5 mm at a peak of mass distribution thereof, it is desirable that the microfibers having a length of at most 1 mm account for from 10 to 65% by mass of the self-weight of the fibrillated rayon.

In the process of forming fibrillated rayon by beating rayon, the length of primary fibers of the fibrillated rayon may sometimes varies to be shorter or longer due to the beating process. In addition, the non-fibrillated rayon (rayon before beating) per se has a deviation in length. Therefore, in the above, such variation and deviation in fiber length has been taken into consideration. Where the length of the rayon before beating is 3 mm, 4mm, 5 mm, 6 mm or 7 mm, for example, the length of the primary fibers at a peak of mass distribution thereof falls in the range of 3±0.5 mm, 4 ±0.5 mm, 5±0.5 mm, 6±0.5 mm or 7±0.5 mm.

Where the ratio of the weight of the microfibers having a length of at most 1 mm to the self-weight of the fibrillated rayon is defined as described above, the fineness of the fibrillated rayon is preferably from 1.2 to 1.9 dtex.

Preferably, the fibers having a length of at most 10 mm are biodegradable fibers. It is desirable that the biodegradable fibers are those of at least one selected from the group consisting of regenerated cellulose, pulp, aliphatic polyesters, polyvinyl alcohol and collagen.

Preferably, the basis weight of the water-decomposable fibrous sheet of the invention falls between 20 and 100 g/m$^2$.

Preferably, the degree of decomposition in water of the fibrous sheet is at most 200 seconds, as measured according to JIS P-4501.

Preferably, the wet strength of the fibrous sheet is at least 110 g/25 mm.

Preferably, the dry strength of the fibrous sheet is at least 350 g/25 mm.

The invention also provides a water-decomposable fibrous sheet, which comprises from 3 to 100% by mass (preferably, 5 to 100% by mass) of fibrillated rayon of such that the primary fibers constituting it have a length of from 1.8 to 10 mm, and from 0 to 97% by mass (preferably, 0 to 95% by mass) of other fibers having a length of at most 10 mm, and which has a basis weight of from 20 to 100 g/m$^2$, a thickness of at least 0.2 mm, a degree of decomposition in water in a previously wetted condition as measured according to JIS P-4501 of at most 200 seconds, and a wet strength of at least 110 g/25 mm.

Preferably, the water-decomposable fibrous sheet of the invention is a non-woven fabric having been subjected to water-jetting treatment. It is bulky and has a soft feel.

Preferably, the fibrillated rayon constituting the fibrous sheet has a degree of beating of at most 400 cc, and the fibrous sheet is produced in a paper-making process.

DESCRIPTION OF PREFERRED EMBODIMENTS OF THE INVENTION

The fibrillated rayon for use in the invention is meant to indicate fibers of regenerated cellulose rayon having finely-fibrillated surfaces, or that is, those with microfibers which are submicron-sized in thickness, having peeled and extending from the surfaces of the primary fibers (of the fibrillated rayon).

Figure 1:
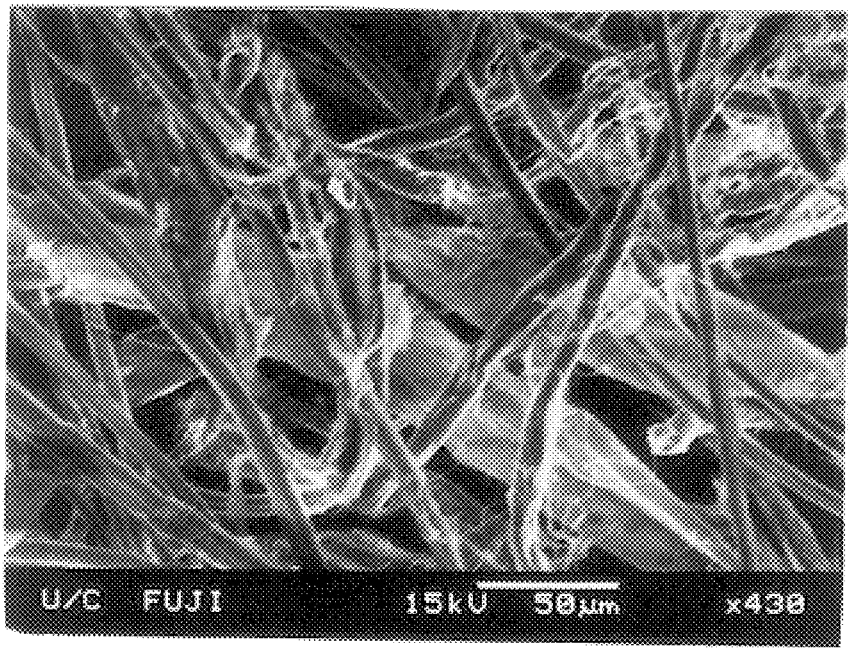
FIG. 1 is a magnified microscopic picture of one example of the water-decomposable fibrous sheet of the invention.
Figure 2:
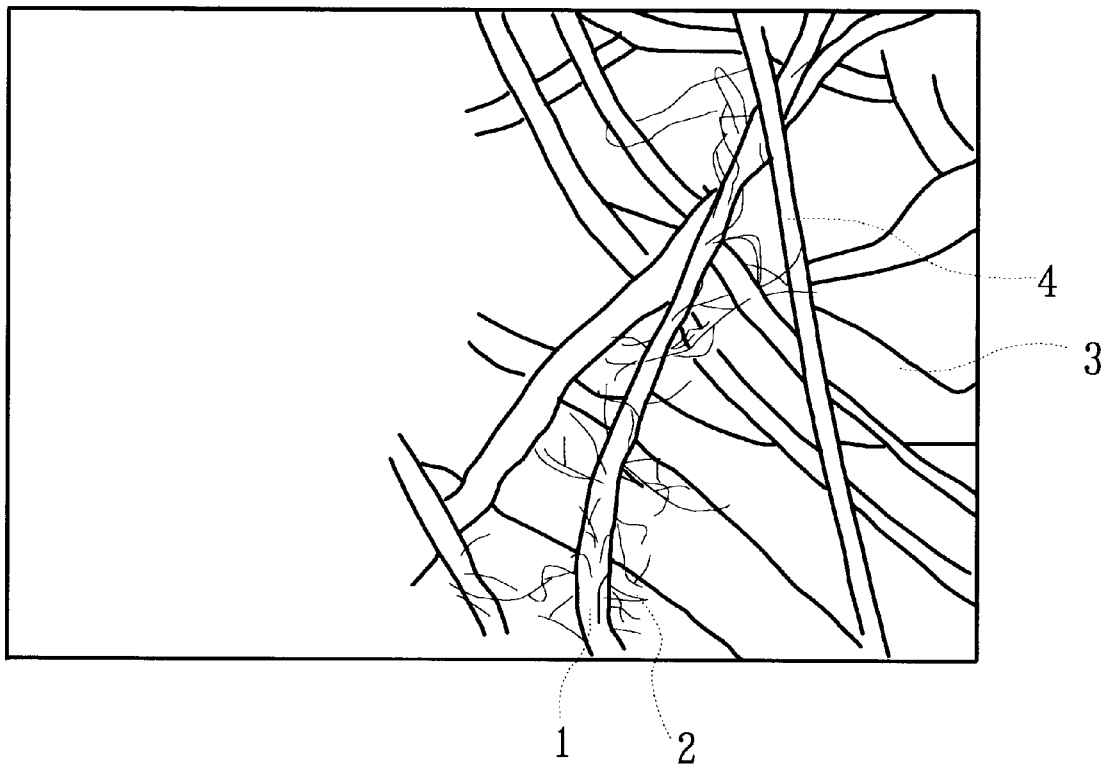
FIG. 2 is a graphical view of the picture of FIG. 1.

FIG. 1 and FIG. 2 are a magnified microscopic picture of one example of the water-decomposable fibrous sheet of the invention that comprises fibrillated rayon 1, rayon 4 and pulp 3, and its graphic view, respectively. The sheet of FIG. 1 and FIG. 2 was prepared from a fibrous web that comprises those fibrillated rayon 1, rayon 4 and pulp 3, by subjecting it to water-jetting treatment. As in FIG. 1 and FIG. 2, it is seen that microfibers 2 extend from the surface of the primary fiber of the fibrillated rayon 1. The surface of ordinary regenerated cellulose (rayon 4) is smooth, while that of the fibrillated rayon 1 is fibrillated to have microfibers 2 therearound, as illustrated; and the two, rayon 4 and fibrillated rayon 1 have different structures.

The fibrillated fibers of that type can be produced, for example, by mechanically processing rayon while it has absorbed water and is still wetted. Concretely, they may be produced, for example, according to a method of strongly stirring rayon in water in a mixer, or a method of beating rayon in a pulper, a refiner, a beater or the like (this is a wet-beating method). More precisely, the fibrillated rayon includes fibers as produced by processing wet-spun rayon such as polynosic or the like with an acid followed by mechanically fibrillating it, fibers as produced by mechanically fibrillating solvent-spun rayon, etc. Apart from those, the fibrillated rayon can also be produced from ordinary, wet-spun regenerated cellulose.

Only the fibrillated rayon, or a combination of the fibrillated rayon and other fibers having a fiber length of at most 10 mm is formed into a fibrous web, and the resulting fibrous web is preferably subjected to water-jetting treatment or the like to be formed into the water-decomposable fibrous sheet of the invention. In this process, the microfibers around the surface of the fibrillated rayon are entangled with the other fibers or the other microfibers. Therefore, the specifically-entangled structure of the fibrous sheet of the invention differs from the structure of ordinary spun-lace non-woven fabric where the constituent fibers are entangled together. From FIG. 1 and FIG. 2, it is seen that the microfibers 2 around the fibrillated rayon 1 are entangled with the other fibers (rayon 4 and fibrillated rayon 1), and the pulp 3 exists among those fibers.

The primary fibers constituting the fibrillated rayon have a length falling between 1.8 mm and 10 mm (at a peak of mass distribution of the primary fibers). The length of the primary fibers as referred to herein is meant to indicate the length of the primary fibers except the microfibers therearound, but not the length of the microfibers. If the length of the primary fibers at a peak of mass distribution thereof is longer than the defined range, not only the microfibers but also the primary fibers will be entangled together, or the primary fibers will be entangled with the other fibers (rayon 4 and pulp 3), at the time of water jetting treatment. In that condition, the water-decomposability of the non-woven fabric will be poor. On the other hand, if the length of the primary fibers is shorter than the defined range, the microfibers could not be entangled to the desired degree. If so, the wet strength of the non-woven fabric will be low. Preferably, the length of the rayon before beating falls between 3 mm and 6 mm. In other words, the length of the primary fibers of the fibrillated rayon at a peak of mass distribution thereof preferably falls between 2.5 mm and 6.5 mm.

Where fibrillated rayon of which the primary fibers have a length of at least 7 mm is used and where the fibrous web is subjected to water-jetting treatment, the primary fibers of the fibrillated rayon will be entangled too much and the decomposability in water of the sheet comprising them will be low. In order to evade the reduction in the decomposability in water of the sheet of that case, it is desirable that the basis weight of the non-woven fabric is controlled to be at most 30 g/m$^2$. In that case, it is also desirable to reduce the proportion of the fibrillated rayon of which the primary fibers have a length of 7 mm or longer, to at most 10% by mass.

To specifically define the fibrillated rayon capable of being preferably used in the invention, some methods may be employed. One is to analyze the mass distribution of the primary fibers and the microfibers constituting the fibrillated rayon. The microfibers are shorter than the primary fibers. Therefore, analyzing the distribution of the fiber length in the fibrillated rayon clarifies the mass distribution of the primary fibers and the microfibers constituting the fibrillated rayon. Another method of specifically defining the intended fibrillated rayon is based on the degree of beating the fibrillated rayon (CSF; Canadian Standard Freeness).

Figure 3:
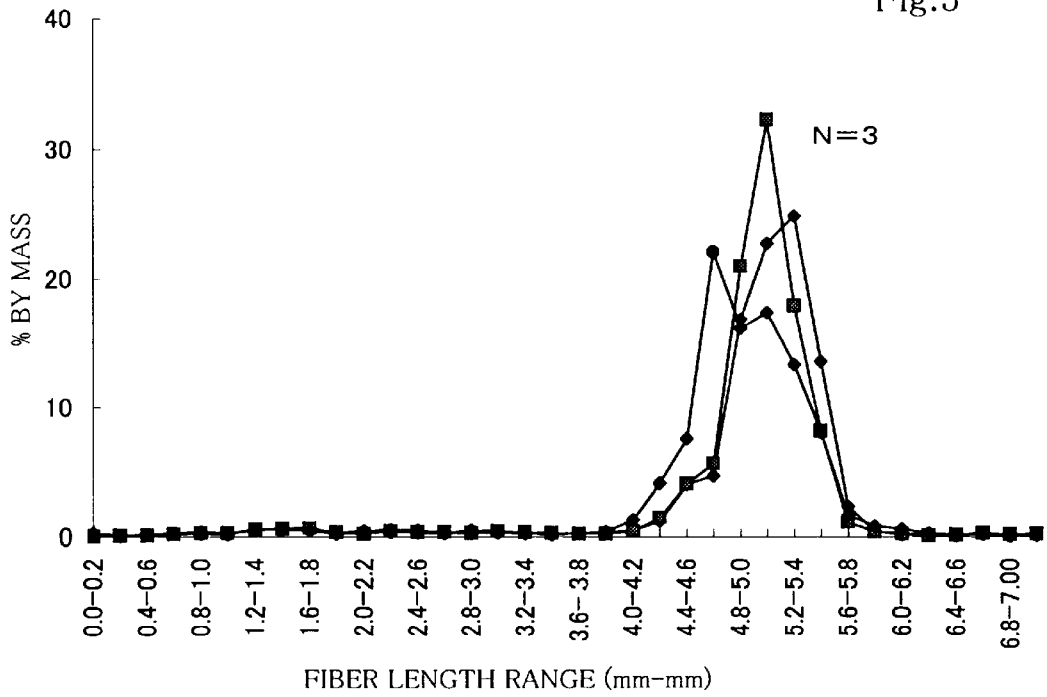
FIG. 3 is a graph showing the mass distribution profile of the fiber length of non-beaten rayon.
Figure 4:
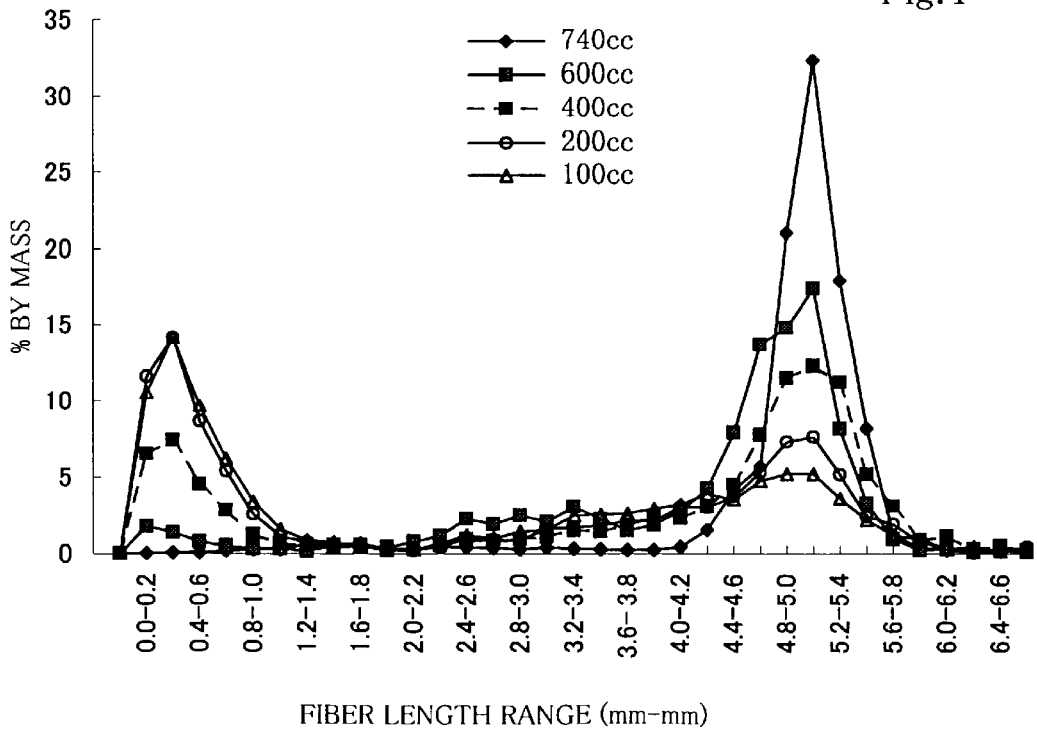
FIG. 4 is a graph showing the mass distribution profile of the fiber length of beaten rayon, for which rayon having a fiber length of 5 mm was beaten.

The mass distribution profile of the fiber length of non-beaten, non-fibrillated rayon (CSF=740 cc, fiber length 5 mm, 1.7 dtex), for which n=3, is shown in FIG. 3. As in FIG. 3, the mass distribution in non-beaten rayon is almost concentrated in the fiber length range of 5 mm±1 mm or so. The non-beaten rayon of FIG. 3 was beaten in wet to different degrees, and the mass distribution of the beaten, fibrillated rayon was analyzed relative to the different fiber lengths. The resulting data are plotted to give the graph of FIG. 4. Rayon samples having a concentration of 0.75% by mass were prepared and beaten in a mixer. As in FIG. 4, the mass distribution gave two peaks. From this, the fibrillated rayon for use in the invention can be identified as one having the fiber length peak for the primary fibers of the fibrillated rayon itself and the fiber length peak for the fibrillated microfibers.

Figure 5:
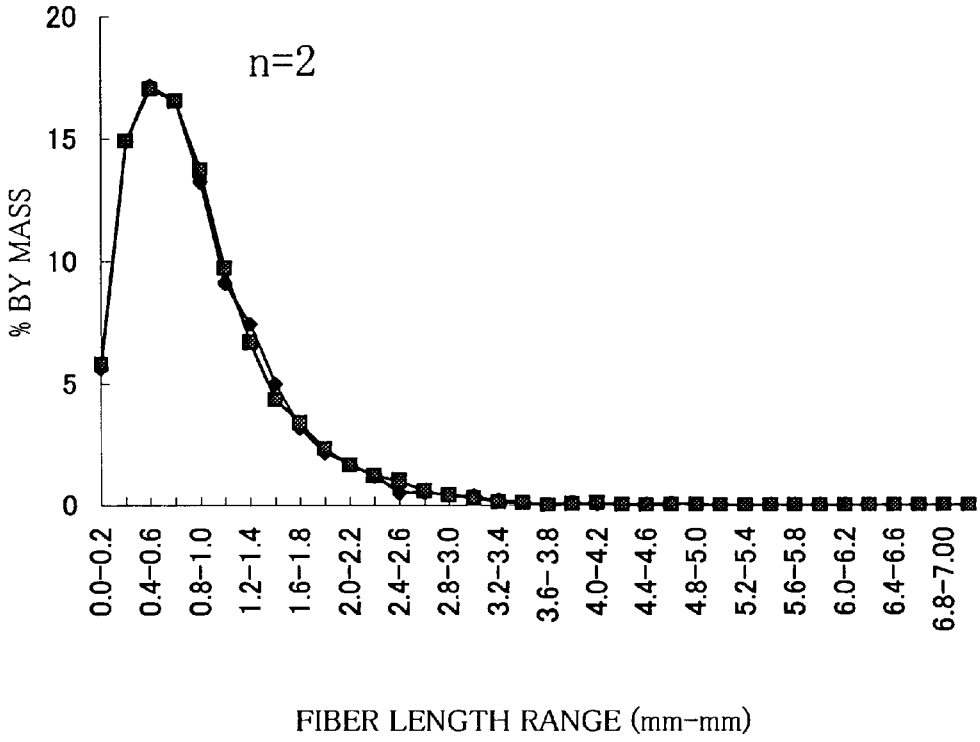
FIG. 5 is a graph showing the mass distribution profile of the fiber length of rayon having been free-beaten.
Figure 6:
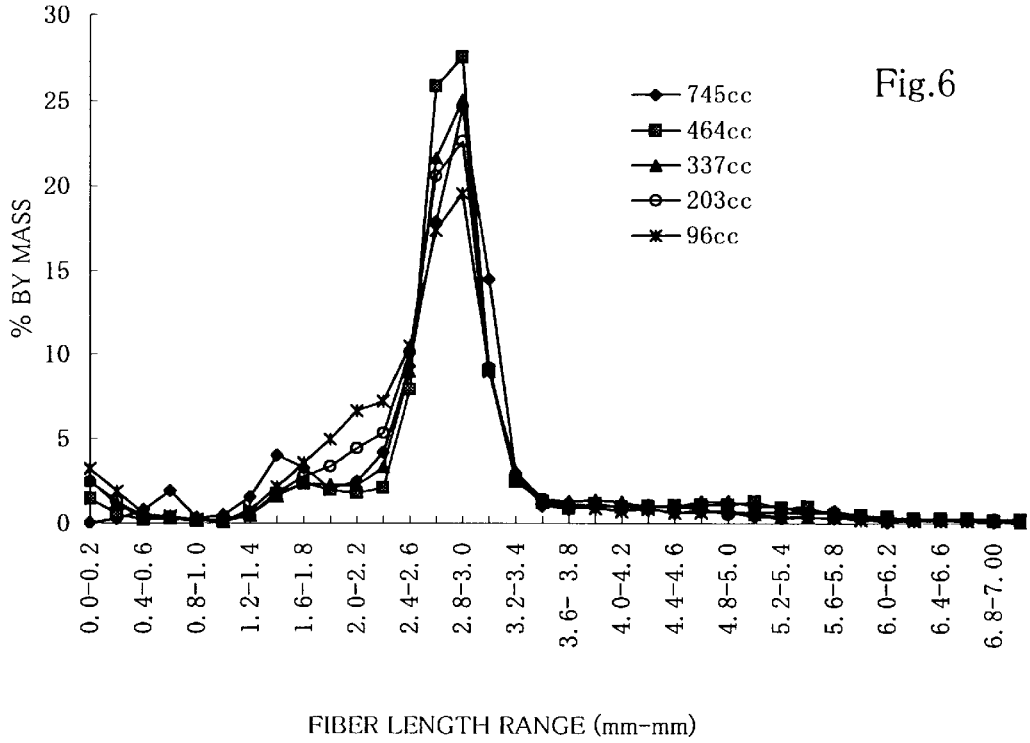
FIG. 6 is a graph showing the mass distribution profile of the fiber length of beaten rayon, for which rayon having a fiber length of 3 mm was beaten in wet.
Figure 7:
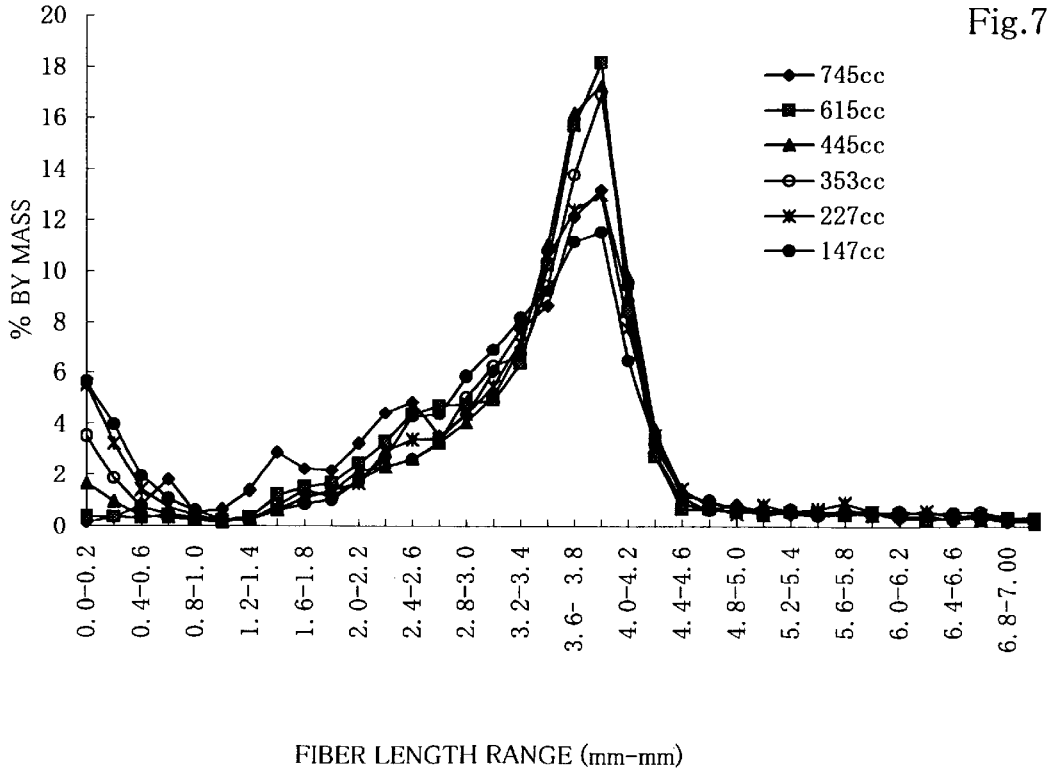
FIG. 7 is a graph showing the mass distribution profile of the fiber length of beaten rayon, for which rayon having a fiber length of 4 mm was beaten in wet.
Figure 8:
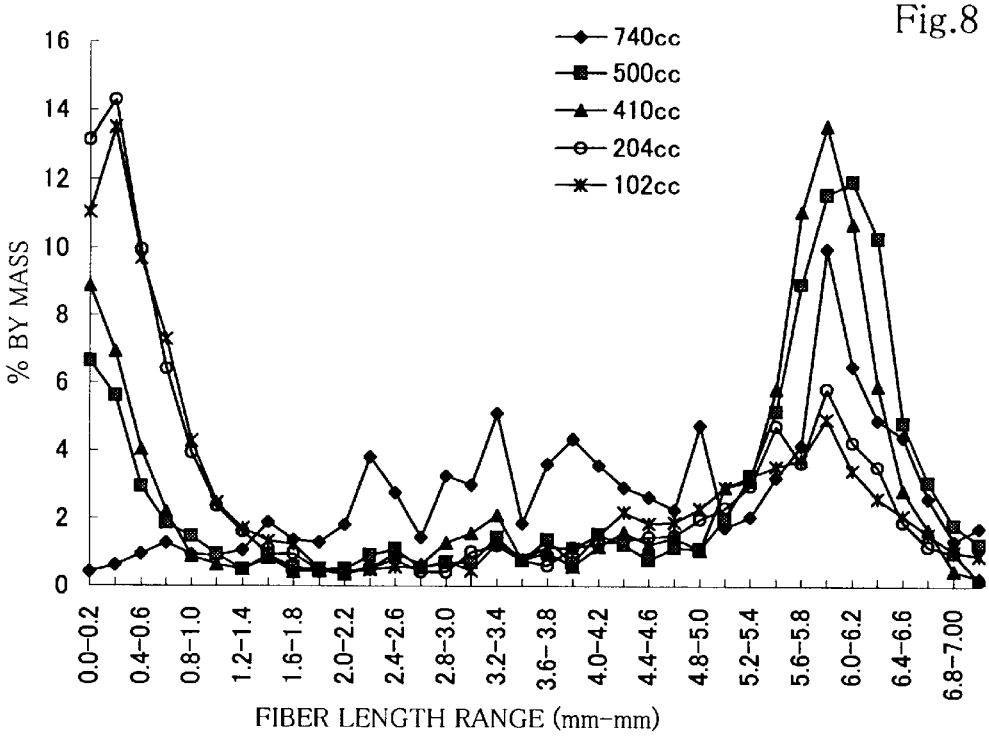
FIG. 8 is a graph showing the mass distribution profile of the fiber length of beaten rayon, for which rayon having a fiber length of 6 mm was beaten in wet.
Figure 9:
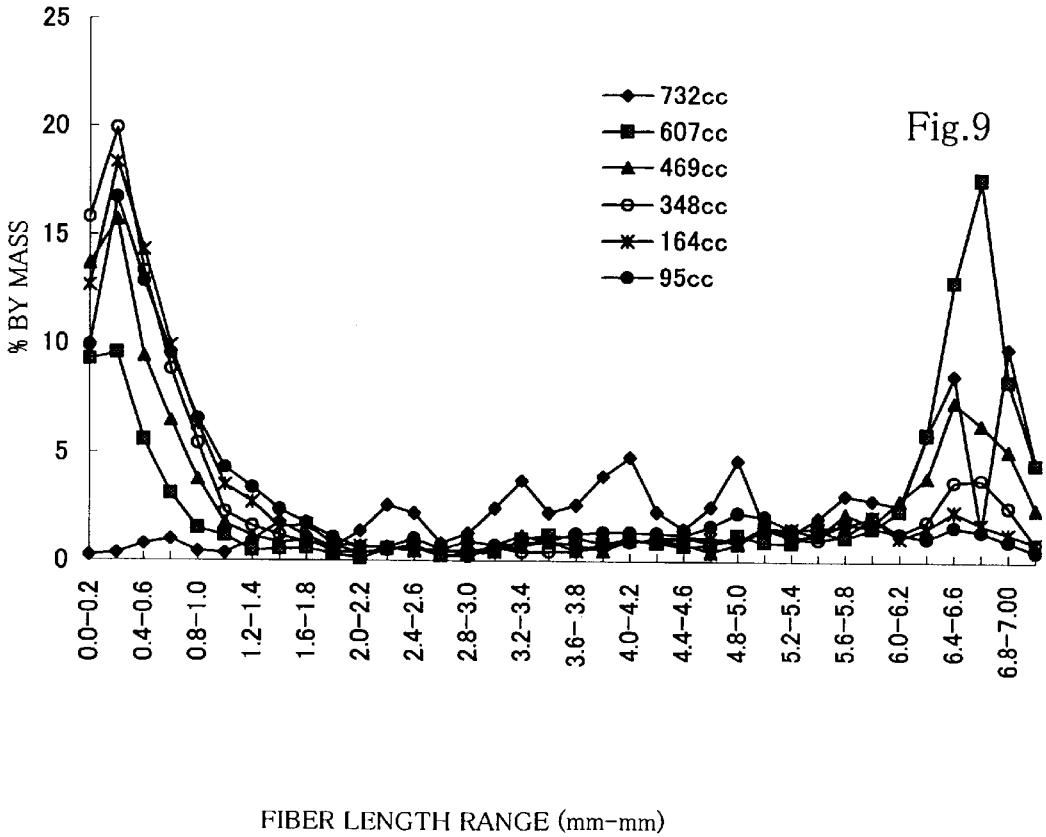
FIG. 9 is a graph showing the mass distribution profile of the fiber length of beaten rayon, for which rayon having a fiber length of 7 mm was beaten in wet.

The fibrillated rayon for use herein is prepared by beating rayon in wet, as in the above. If, being different from this, rayon is beaten in an ordinary free-beating manner to promote its beating (so that the beaten rayon shall have a reduced numerical value indicating its degree of beating), it will be entirely pulverized into small particles, as in FIG. 5. In that condition, most of the rayon would lose the original fiber length. The free-beaten rayon is not within the scope of the fibrillated rayon for use in the invention.

Regarding the ratio of the microfibers to the fibrillated rayon preferred for use in the invention, it is desirable that the microfibers extending from the primary fibers of the fibrillated rayon and having a length of at most 1 mm account for from 0.1 to 65% by mass of the self-weight of the fibrillated rayon. The fibrillated rayon having the morphology of that type may be obtained by beating rayon to a degree of at most 700 cc. With the fibrillated rayon, the fibrous sheet could well decompose in water and could have a preferred degree of strength. In the fibrillated rayon of that type, the remaining part that accounts for approximately from 35 to 99.9% by mass essentially comprises the primary fibers of the fibrillated rayon, but including long microfibers having been prolonged through promoted fibrillation and also chopped rayon. As the case may be, the length of the primary fibers of the beaten, fibrillated rayon will be somewhat smaller than the original length of those of the non-beaten rayon, or will be somewhat prolonged in appearance owing to the microfibers extending from the end parts of the primary fibers. Therefore, the length of the primary fibers at a peak of mass distribution thereof will be the original length of the non-beaten rayon (rayon before beating)±0.5 mm.

The mass distribution of the fibrillated rayon relative to the fiber length depends on both the original fiber length of the non-beaten rayon and the degree of beating of the fibrillated rayon. In reference to this, rayon having a different fiber length of 3 mm, 4 mm, 6 mm or 7 mm was beaten in wet, and the mass distribution of the beaten rayon relative to the varying fiber length was analyzed. The data were plotted to give the graphs of FIG. 6 to FIG. 9. Of the beaten rayon samples whose data are plotted as in the graphs of FIG. 4 and FIGS. 6 to 9 the mass distribution of the microfibers having a length of at most 1 mm and the mass distribution of the primary fibers whose length is near to the original fiber length of the non-beaten rayon (but having varied within a range of from −0.6 mm to +0.4 mm) are given in Table 1—1 below.

As seen from the graphs of FIGS. 6 to 9, in the fibrillated rayon after beating, the length of the primary fibers at a peak of mass distribution of the primary fibers varies ±0.5 mm, 0.3 mm, or −0.3 to +0.1 mm, from the original length of the rayon before beating.

TABLE 1-1

| | Degree of Beating (cc) | not longer than 1.0 mm (% by mass) | |
|---|---|---|---|
| | | | 2.4 to 3.4 mm (% by mass) |
| 3 mm | 745 | 3.36 | 60.33 |
| | 464 | 2.61 | 72.84 |
| | 337 | 4.40 | 67.89 |
| | 203 | 4.49 | 65.35 |
| | 96 | 6.31 | 58.86 |
| | | | 3.4 to 4.4 mm (% by mass) |
| 4 mm | 745 | 3.78 | 45.66 |
| | 615 | 1.85 | 55.19 |
| | 445 | 3.70 | 58.02 |
| | 353 | 7.02 | 59.58 |
| | 227 | 11.47 | 47.23 |
| | 147 | 13.28 | 41.51 |
| | | | 4.4 to 5.4 mm (% by mass) |
| 5 mm | 740 | 0.69 | 76.56 |
| | 600 | 4.06 | 63.80 |
| | 400 | 22.49 | 47.25 |
| | 200 | 35.95 | 32.77 |
| | 100 | 41.76 | 22.72 |
| | | | 5.4 to 6.4 mm (% by mass) |
| 6 mm | 740 | 4.19 | 28.64 |
| | 500 | 18.45 | 47.78 |
| | 410 | 22.90 | 46.98 |
| | 204 | 47.74 | 21.85 |
| | 102 | 45.81 | 18.12 |
| | | | 6.4 to 7.2 mm (% by mass) |
| 7 mm | 732 | 2.83 | 34.29 |
| | 607 | 28.98 | 43.07 |
| | 469 | 49.06 | 24.96 |
| | 348 | 63.29 | 10.72 |
| | 164 | 61.53 | 6.19 |
| | 95 | 55.58 | 4.39 |

Next, in Table 1–2, the proportion of the microfibers having a length of at most 1.0 mm is given, when rayon having an original fiber length of 5 mm and having a fineness of 1.7 dtex was beaten while varying the degree of beating step by step in the range of from 740 cc to 67 cc. In Table 1–3, the proportion of the microfibers having a length of at most 1.0 mm is given, when rayon having an original fiber length of 3 mm and having a fineness of 1.4 dtex was beaten while varying the degree of beating step by step in the range of from 644 cc to 211 cc, and when rayon having an original fiber length of 3 mm and having a fineness of 1.7 dtex was beaten while varying the degree of beating step by step in the range of from 653 cc to 163 cc. In Table 1–4, the proportion of the microfibers having a length of at most 1.0 mm is given, when rayon having an original fiber length of 5 mm and having a fineness of 1.4 dtex was beaten while varying the degree of beating step by step in the range of from 676 cc to 135 cc, and when rayon having an original fiber length of 5 mm and having a fineness of 1.7 dtex was beaten while varying the degree of beating step by step in the range of from 695 cc to 186 cc.

TABLE 1-2

| | Degree of Beating (cc) | 1.0 mm or less (% BY MASS) |
|---|---|---|
| 5 mm | 740 | 0.69 |
| I.7dtex | 520 | 12.77 |
| | 377 | 23.20 |
| | 185 | 39.37 |
| | 67 | 35.47 |

TABLE 1-3

| | Degree of Beating (cc) | 1.0 mm or less (% BY MASS) |
|---|---|---|
| 3 mm | 644 | 0.57 |
| I.4dtex | 626 | 0.46 |
| | 595 | 0.40 |
| | 563 | 0.78 |
| | 480 | 0.71 |
| | 407 | 0.69 |
| | 352 | 0.87 |
| | 340 | 1.05 |
| | 297 | 1.32 |
| | 241 | 1.39 |
| | 211 | 1.77 |
| 3 mm | 653 | 0.16 |
| I.7dtex | 584 | 0.23 |
| | 472 | 0.43 |
| | 372 | 0.59 |
| | 333 | 0.63 |
| | 291 | 1.13 |
| | 259 | 1.25 |
| | 212 | 1.54 |
| | 176 | 1.92 |
| | 163 | 3.61 |

TABLE 1-4

| | Degree of Beating (cc) | 1.0 mm or less (% BY MASS) |
|---|---|---|
| 5 mm | 676 | 1.08 |
| I.4dtex | 646 | 1.06 |
| | 631 | 2.08 |
| | 554 | 8.48 |
| | 433 | 7.39 |
| | 339 | 11.18 |
| | 242 | 21.57 |
| | 183 | 20.43 |
| | 161 | 26.55 |
| | 135 | 24.32 |
| 5 mm | 695 | 0.47 |
| I.7dtex | 625 | 1.49 |
| | 521 | 7.17 |
| | 229 | 20.96 |
| | 200 | 17.14 |
| | 198 | 20.04 |
| | 198 | 18.10 |
| | 198 | 17.59 |
| | 195 | 16.92 |
| | 195 | 15.08 |
| | 190 | 15.14 |
| | 188 | 19.54 |
| | 187 | 17.41 |
| | 186 | 13.94 |

In Table 1—1, the data in the thick-lined boxes are of the fibrillated rayon most preferred for use in the invention. Also, the data in Tables 1–2, 1–3 and 1–4, exclusive of the data of one having a degree of beating of 740 cc in Table 1–2, are of the fibrillated rayon most preferred for use in the invention. Here, the data in Tables 1—1 and 1–2 were obtained by beating rayon with a mixer, while the data in Tables in 1–3 and 1–4 were obtained by beating rayon with a pulper or refiner used for mass-production. As in above Tables, it is understood that the percentage (by mass) of the microfibers having a length of at most 1 mm of the fibrillated rayon prepared by using a pulper or refiner becomes less than that prepared by using a mixer. However, the water-decomposable fibrous sheet of the invention may be produced by using any one of the above means (mixer, pulper and refiner) to obtain well balanced water-decomposability and wet strength.

In the preferred ranges where the length of the rayon before beating is from 3 mm to less than 5 mm (i.e., where the length of the primary fibers of the fibrillated rayon at a peak of mass distribution thereof is from 2.5 mm to less than 4.5 mm) and where the degree of beating is smaller than 400 cc, the microfibers having a length of at most 1 mm account for from 0.5 to 15% by mass of the self-weight (total mass) of the fibrillated rayon. However, if a pulper or refiner is used for beating rayon, the upper limit of 15% by mass varies to about 8% by mass. In those where the length of the rayon before beating is from 3 mm to less than 5 mm (i.e., where the length of the primary fibers of the fibrillated rayon at a peak of mass distribution thereof is from 2.5 mm to less than 4.5 mm) and where the degree of beating is from 400 cc to 700 cc, the microfibers having a length of at most 1 mm account for from 0.1 to 5% by mass of the self-weight of the fibrillated rayon. However, if a pulper or refiner is used for beating rayon, the upper limit of 5% by mass varies to about 3% by mass. If the degree of beating is from 400 cc to 600 cc, the lower limit of 0.1% by mass varies to 0.2% by mass.

Still in those where the length of the rayon before beating is from 5 mm to 7 mm (i.e., where the length of the primary fibers of the fibrillated rayon at a peak of mass distribution thereof is from 4.5 mm to 7.5 mm) and where the degree of beating is smaller than 400 cc, the microfibers having a length of at most 1 mm account for from 8 to 65% by mass of the self-weight of the fibrillated rayon. However, if a pulper or refiner is used for beating rayon, the upper limit of 65% by mass varies to about 30% by mass, and the lower limit of 8% by mass varies to 5% by mass. Further in those where the length of the rayon before beating is from 5 mm to 7 mm (i.e., where the length of the primary fibers of the fibrillated rayon at a peak of mass distribution thereof is from 4.5 mm to 7.5 mm) and where the degree of beating is from 400 cc to 700 cc, the microfibers having a length of at most 1 mm account for from 0.3 to 50% by mass of the self-weight of the fibrillated rayon. However, if a pulper or refiner is used for beating rayon, the upper limit of 50% by mass varies to about 20% by mass. If the degree of beating is from 400 cc to 600 cc, the lower limit of 0.3% by mass varies to 2% by mass.

Moreover, in the preferred ranges where the rayon before beating has a length of 3 mm (i.e., where the primary fibers of the fibrillated rayon have a length of 3 ±0.5 mm at a peak of mass distribution thereof), the microfibers having a length of at most 1 mm account for from 0.1 to 10% by mass of the self-weight of the fibrillated rayon. However, if a pulper or refiner is used for beating rayon, the upper limit of 10% by mass varies to about 5% by mass. If the degree of beating is less than 600 cc, the lower limit of 0.1% by mass varies to 0.2% by mass.

In those where the rayon before beating has a length of 4 mm (i.e., where the primary fibers of the fibrillated rayon have a length of 4±0.5 mm at a peak of mass distribution thereof), the microfibers having a length of at most 1 mm account for from 1 to 14% by mass of the self-weight of the fibrillated rayon. However, if a pulper or refiner is used for beating rayon, the range varies to about 0.3 to 10% by mass. If a pulper or refiner is used for beating rayon and the degree of beating is less than 600 cc, the lower limit varies to 0.5% by mass.

In those where the rayon before beating has a length of 5 mm (i.e., where the primary fibers of the fibrillated rayon have a length of 5±0.5 mm at a peak of mass distribution thereof), the microfibers having a length of at most 1 mm account for from 0.3 to 45% by mass of the self-weight of the fibrillated rayon. However, if a pulper or refiner is used for beating rayon, the upper limit of 45% by mass varies to about 30% by mass. If a pulper or refiner is used for beating rayon and the degree of beating is less than 600 cc, the lower limit varies to 5% by mass.

In those where the rayon before beating has a length of 6 mm (i.e., where the primary fibers of the fibrillated rayon have a length of 6±0.5 mm at a peak of mass distribution thereof), the microfibers having a length of at most 1 mm account for from 5 to 50% by mass of the self-weight of the fibrillated rayon. However, if a pulper or refiner is used for beating rayon, the range varies to about 0.5 to 30% by mass. If a pulper or refiner is used for beating rayon and the degree of beating is less than 600 cc, the lower limit varies to 5% by mass.

In those where the rayon before beating has a length of 7 mm (i.e., where the primary fibers of the fibrillated rayon have a length of 7±0.5 mm at a peak of mass distribution thereof), the microfibers having a length of at most 1 mm account for from 10 to 65% by mass of the self-weight of the fibrillated rayon. However, if a pulper or refiner is used for beating rayon, the range varies to about 3 to 50% by mass. If a pulper or refiner is used for beating rayon and the degree of beating is less than 600 cc, the lower limit varies to 8% by mass.

Where the ratio of the weight of the microfibers having a length of at most 1 mm to the self-weight of the fibrillated rayon is defined as described above, the fineness of the fibrillated rayon is preferably from 1.2 to 1.9 dtex.

The degree of beating of the fibrillated rayon preferred for use in the invention is described. Where beating rayon is promoted (to give a beaten, fibrillated rayon that shall have a lowered numerical value indicating its degree of beating), the ratio of the mass distribution of short fibers (including microfibers) will increase. In the invention, the fibrillated rayon preferably has a degree of beating of at most 700 cc. Fibrillated rayon having a degree of beating of larger than 700 cc could not have a strength necessary for the water-decomposable fibrous sheet of the invention. More preferably, the fibrillated rayon for use herein has a degree of beating of at most 600 cc. The increase in the strength of the fibrous sheet will be more noticeable owing to the microfibers of the fibrillated rayon of that preferred type. Most preferably, the fibrillated rayon has a degree of beating of at most 400 cc. Even when fibrillated rayon having a degree of beating of at most 200 cc, or even at most 100 cc (for example, 50 cc or 0 cc) is used in producing it, the water-decomposable fibrous sheet could have well-balanced wet strength and decomposability in water.

However, if fibrillated rayon having been too much beaten (thereby having a too much reduced numerical value indicating its degree of beating), for example that having a degree of being of 0 cc is used, the degree of water filtration through the sheet in its production will be low. Therefore, it is desirable that the fibrous sheet comprises a combination of the fibrillated rayon of that type and other fibers. In this case, the proportion of the fibrillated rayon is preferably at most 30%, more preferably at most 20%. Also preferably, the fiber length of the fibrillated rayon (before beating) is at most 6 mm, more preferably at most 5 mm.

The degree of beating of the fibrillated rayon can be controlled by varying the beating time and by selecting the beating means. For example, when rayon is beaten in a mixer, the time for processing it therein may be suitably determined. To obtain the fibrillated rayon, for example, a liquid containing rayon is processed in a mixer. For this, for example, the liquid may have a rayon concentration of 0.75%, and it will be processed in an ordinary, commercially-available 100V mixer. In this case, the degree of beating of the fibrillated rayon will be correlated with the beating time in the mixer, in the manner mentioned below. The following data may have an error of ±30 seconds for the beating time. Where the rayon concentration is varied, the beating time in the mixer to attain the intended degree of beating shall vary.

Beating time, 2 minutes; degree of beating 700 cc

Beating time, 3 minutes; degree of beating 600 cc

Beating time, 4 minutes; degree of beating 500 cc

Beating time, 5 minutes; degree of beating 300 cc

Beating time, 7 to 8 minutes; degree of beating=200 cc

Beating time, 8 to 10 minutes; degree of beating=50 cc

Where rayon (degree of beating, 740 cc; fiber length, 5 mm; 1.7 dtex) is beaten in a pulper in place of the mixer as in the above, the data will be as follows:

Beating time, 120 minutes; degree of beating=629 cc

Beating time, 330 minutes; degree of beating=237 cc

Figure 10:
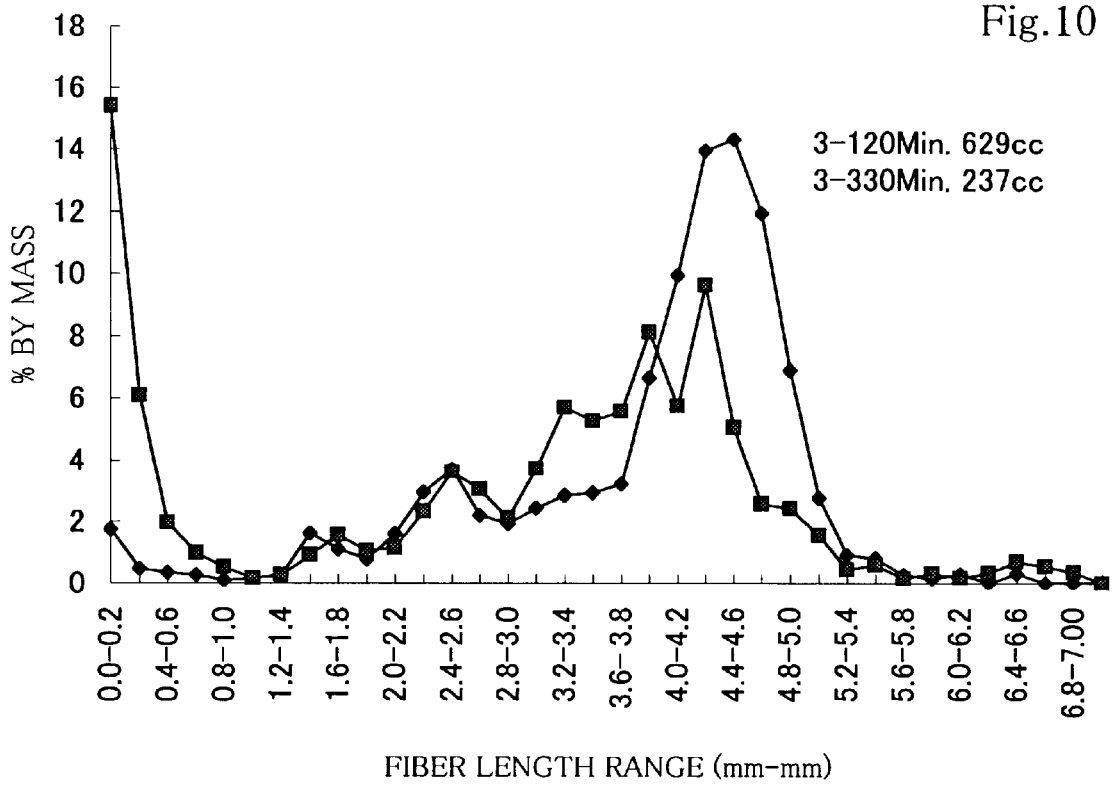
FIG. 10 is a graph showing the mass distribution profile of the fiber length of beaten rayon, for which rayon having a fiber length of 5 mm was beaten in wet.

The mass distribution of the fiber length of the beaten rayon is as in FIG. 10.

The fineness of the fibrillated rayon in terms of denier is preferably from 1 to 7 d (denier), that is, from 1.1 to 7.7 dtex or so. If its fineness is smaller than the defined range, the primary fibers of the fibrillated rayon will be too much entangled, and the decomposability in water of the fibrous sheet comprising it will be low. If, on the other hand, its fineness is larger than the defined range, the formation of the fibrous sheet will be not good and, in addition, the productivity thereof will be low.

The fiber length of the fibrillated rayon, the mass distribution thereof relative to the fiber length, the degree of beating thereof, and the fineness thereof will be suitably controlled, depending on their data, the proportion of the fibrillated rayon, and the type of the other fibers to be blended with the fibrillated rayon.

The water-decomposable fibrous sheet of the invention may be made of only the fibrillated rayon, but may contain any other fibers having a length of at most 10 mm in addition to the fibrillated rayon. In the water-decomposable fibrous sheet comprising the fibrillated rayon and such other fibers, the microfibers of the fibrillated rayon will be well entangled with the other fibers to ensure high strength of the sheet. The microfibers entangled with the other fibers in the sheet will be released from them when a large amount of water is given to the sheet, and therefore the sheet easily decomposes in water.

As the other fibers having a length of at most 10 mm, preferred are those well dispersible in water, that is, water-dispersible fibers. The dispersibility in water referred to herein has the same meaning as the decomposability in water, and is meant to indicate that the fibers are dispersed well in water when kept in contact with a large amount of water. More preferably, those other fibers are biodegradable fibers. The biodegradable fibers naturally decompose by themselves when disposed of in the natural world. The length of the other fibers for use herein is meant to indicate the mean length thereof The lower limit of the length (or mean length) of the other fibers is preferably 1 mm or more.

The other fibers for use in the invention may be those of at least one sort selected from the group consisting of natural fibers and chemical fibers. The natural fibers include those from wood pulp such as soft wood pulp, hard wood pulp, etc.; and also those from Manila hemp, linter pulp, etc. These natural fibers are biodegradable. Of those, preferred are bleached soft-wood kraft pulp, and bleached hard-wood kraft pulp, as having high dispersibility in water. Also usable herein are chemical fibers such as regenerated fibers of rayon, etc.; synthetic fibers of polypropylene, polyvinyl alcohol, polyester, polyacrylonitrile, etc.; biodegradable synthetic fibers; synthetic pulp of polyethylene, etc. Of those, preferred is rayon, as being biodegradable. Further usable are still other biodegradable fibers of polylactic acid, polycaprolactone, aliphatic polyesters such as polybutylene succinate, polyvinyl alcohol, collagen, etc. Needless-to-say, any fibers other than those mentioned above are usable herein so far as they are dispersible in water.

For the soft wood pulp, its degree of beating preferably falls between 500 and 700 cc or so. If its degree of beating is smaller than the defined range, the non-woven fabric comprising the pulp will have a paper-like morphology, and will have a rough feel. If, however, its degree of beating is larger than the defined range, the sheet comprising the pulp could not have the necessary strength.

The water-decomposable fibrous sheet of the invention may be formed of only the fibrillated rayon or a combination of the fibrillated rayon and other fibers having a length of at most 10 mm. Here, the ratio of the components is preferably such that the proportion of the fibrillated rayon is from 3 to 100% by mass and that of the other fibers is from 0 to 97% by mass, more preferably such that the proportion of the fibrillated rayon is from 5 to 100% by mass and that of the other fibers is from 0 to 95% by mass, still more preferably such that the proportion of the fibrillated rayon is from 5 to 70% by mass and that of the other fibers is from 30 to 95% by mass, most preferably such that the proportion of the fibrillated rayon is from 10 to 50% by mass and that of the other fibers is from 50 to 90% by mass.

Also preferably, the basis weight (this may be referred to as "Metsuke") of the fibrous sheet of the invention falls between 20 and 100 g/m$^2$, in order that the sheet can bear wiping in wet. If its basis weight is smaller than the defined range, the sheet could not have the necessary wet strength. If, however, its basis weight is larger than the defined range, the sheet will be not flexible. In particular, for application to the skin of human bodies, the basis weight of the sheet is more preferably from 30 to 70 g/m$^2$, in view of the wet strength and the soft feel of the sheet.

The water-decomposable fibrous sheet may be used directly after it has been produced in a wet paper-making process or the like. The water-decomposable fibrous sheet could ensure its strength owing to the entangled microfibers therein, and, in addition, its dry strength could be increased owing to the hydrogen bonding at the OH groups existing on the surfaces of the fibrillated rayon therein. As the degree of beating increases, that is, as the number of the microfibers increases, the surface area of the fibers increases, to thereby enhance the strength of the hydrogen bonding between fibers.

For more surely increasing its wet strength, the fibrous sheet is preferably in the form of a non-woven fabric that may be produced by forming a fibrous web of fibrillated rayon alone or of fibrillated rayon combined with other fibers, for example, in a wet process, followed by subjecting the fibrous web to water-jetting treatment. The fibrous web referred to herein is meant to indicate a sheet as prepared by sheeting a fibrous block in such a manner that the fibers constituting it are oriented in some degree in a predetermined direction. The fibrous web may also be prepared in a dry process, and may be subjected to water-jetting treatment. For the water-jetting treatment, employed is an ordinary high-pressure water-jetting device. Through the water-jetting treatment, the fibrous web is formed into a non-woven fabric that is bulky as a whole and has a soft feel like cloth. In addition, the non-woven fabric has a strong wet strength enough for its use, and when kept in contact with a large amount of water after disposed of in toilets and others, it well decomposes in water as the microfibers entangled therein and even the fibers loosely entangled therein come untied while in water.

The details of the water-jetting treatment are described. The fibrous web is put on a continuously moving conveyor belt, and exposed to high-pressure water-jetting streams to such a degree that the streams applied thereto could pass through its back surface. Through the water-jetting treatment, the properties of the non-woven fabric are changed, depending on the basis weight of the fibrous web processed, the pore diameter of the jetting nozzle used, the number of pores of the jetting nozzles, the feeding speed at which the fibrous web is processed with the water-jetting streams (processing speed), etc. For example, when the work done to be derived from the following formula:

Work done (kW/m$^2$)

$$=\{1.63\times\text{jetting pressure (kgf/cm}^2\text{ or Pa)}\times\text{jetting flow rate (m}^3\text{/min)}\}/\text{processing speed (m/min)},$$

is from 0.04 to 0.5 (kW/m$^2$) in one treatment for one surface of the fibrous web, a favorable non-woven fabric can be produced by subjecting the fibrous web to the water-jetting treatment once or repeated 2 to 6 times. In this case, if the fibers are entangled too much by repeating the water-jetting treatment more, the decomposability in water of the resulting non-woven fabric will be lowered. Moreover, if the work done in one treatment is larger than the defined range, the fibrous web may be broken. If, on the other hand, the work done in one treatment is smaller than the defined range, the processed non-woven fabric could not be bulky to a desired degree. One or both surfaces of the fibrous web may undergo the water-jetting treatment. If the processing conditions are changed variously, favorable non-woven fabrics could be obtained even though the work done does not fall within the preferred range.

After having been formed, it is desirable that the fibrous web is directly subjected to the water-jetting treatment without being dried, for simplifying the process for the treatment. However, the fibrous web may be subjected to the water-jetting treatment after having been once dried.

Preferably, the strength at break in wet of the water-decomposable fibrous sheet of the invention that contains water is at least 110 g/25 mm in terms of the root of the product obtained by multiplying the strength in the machine direction (MD) by that in the cross direction (CD). The strength at break in wet (this is herein referred to as wet strength) is meant to indicate the tensile strength at break (gf) of the fibrous sheet in wet. To obtain its wet strength in terms of the tensile strength at break, a piece of the fibrous sheet having a width of 25 mm and a length of 150 mm is immersed in water to thereby infiltrate water of 2.5 times the mass of the sheet into the sheet piece, and the thus-wetted sheet piece is pulled until it is broken, by the use of a Tensilon tester, for which the chuck distance is 100 mm and the stress rate is 100 mm/min.

However, the data thus measured according to the method are merely the criterion for the strength of the fibrous sheet, and the fibrous sheet of the invention will be comfortably used for wiping purposes so far as it has a strength that is substantially the same as the wet strength thereof measured in the manner as above. More preferably, the wet strength of the fibrous sheet is at least 130 g/25 mm.

On the other hand, it is also desirable that the fibrous sheet has high strength enough for its use even in dry. Therefore, the dry strength of the fibrous sheet is preferably at least 350 g/25 mm in terms of the root of the product obtained by multiplying the strength at break in the machine direction (MD) by that in the cross direction (CD).

Also preferably, the water-decomposable fibrous sheet of the invention has a degree of decomposition in water of at most 300 seconds, more preferably at most 200 seconds, even more preferably at most 150 seconds, the most preferably at most 100 seconds. The degree of decomposition in water is measured according to the test method of JIS P-4501 that indicates the degree of easy degradation of toilet paper in water. The outline of the paper degradation test method is described. A piece of the water-decomposable fibrous sheet of the invention having a length of 10 cm and a width of 10 cm is put into a 300-ml beaker filled with 300 ml of ion-exchanged water, and stirred therein with a rotor. The revolution speed of the rotor is 600 rpm. The condition of the test piece being dispersed in water is macroscopically observed, and the time until the test piece is finely dispersed is measured.

However, the data thus measured according to the method are merely the criterion for the decomposability in water of the fibrous sheet, and the fibrous sheet of the invention will be disposed of in flush toilets and others with no problem so far as it has a degree of decomposition in water that is substantially the same as the data measured in the manner as above.

To make the water-decomposable fibrous sheet of the invention have a degree of decomposition in water and a wet strength falling within the preferred ranges noted above, the type of the fibers constituting the sheet, the proportion of the fibers, the basis weight of the sheet, and the conditions for the water-jetting treatment for the sheet may be varied. For example, where fibrillated rayon of which the primary fibers are long is used, or where fibrillated rayon not beaten so much (that is, having an increased numerical value indicating its degree of beating) is used, the basis weight of the non-woven fabric is reduced, or the proportion of the fibrillated rayon is reduced, or the processing energy for the water-jetting treatment is reduced, whereby the fibrous sheet obtained could have an increased degree of decomposition in water and an increased wet strength. On the other hand, where fibrillated rayon having been much beaten (that is, having a reduced numerical value indicating its degree of beating) is used, the proportion of the fibrillated rayon is increased or the basis weight of the non-woven fabric is increased to obtain the better results.

Even though not containing a binder, the water-decomposable fibrous sheet of the invention could have a high degree of decomposition in water and a high wet strength. However, in order to further increase the wet strength of the sheet, a water-soluble or water-swellable binder capable of binding fibers together may be added to the sheet. The binder includes, for example, carboxymethyl cellulose; alkyl celluloses such as methyl cellulose, ethyl cellulose, benzyl cellulose, etc.; polyvinyl alcohol; modified polyvinyl alcohols having a predetermined amount of a sulfonic group or a carboxyl group, etc. The amount of the binder to be added to the sheet may be small. For example, only about 2 g of the binder, relative to 100 g of the fibers constituting the sheet, may be added to the sheet whereby the wet strength of the sheet could be much increased. As being soluble or swellable in water, the binder dissolves or swells in water when kept in contact with a large amount of water. To add the water-soluble binder to the non-woven fabric, employable is a coating method of applying the binder to the non-woven fabric through a silk screen. On the other hand, the water-swellable binder may be added to the fibrous web for the sheet while the fibrous web is prepared in a paper-making process.

Where the binder is added to the fibrous sheet of the invention, an electrolyte such as a water-soluble inorganic or organic salt may be added thereto along with the binder, whereby the wet strength of the sheet could be increased much more. The inorganic salt includes, for example, sodium sulfate, potassium sulfate, zinc sulfate, zinc nitrate, potassium alum, sodium chloride, aluminium sulfate, magnesium sulfate, potassium chloride, sodium carbonate, sodium hydrogencarbonate, ammonium carbonate, etc.; and the organic salt includes, for example, sodium pyrrolidone-carboxylate, sodium citrate, potassium citrate, sodium tartrate, potassium tartrate, sodium lactate, sodium succinate, calcium pantothenate, calcium lactate, sodium laurylsulfate, etc. Where an alkyl cellulose is used as the binder, it is preferably combined with a monovalent salt. Where a modified or non-modified polyvinyl alcohol is used as the binder, it is preferably combined with a monovalent salt.

In addition, where an alkyl cellulose is used as the binder, any of the following compounds may be added to the water-decomposable fibrous sheet so as to further increase the strength of the sheet. The additional compounds include, for example, copolymers of a polymerizable acid anhydride monomer with other comonomers, such as (meth)acrylic acid-maleic acid resins, (meth)acrylic acid-fumaric acid resins, etc. Preferably, the copolymers are saponified with sodium hydroxide or the like into water-soluble copolymers partially having a sodium carboxylate moiety. Adding an amino acid derivative such as trimethylglycine or the like to the sheet is also desirable, as also enhancing the strength of the sheet.

To ensure the desired degree of decomposition in water and the desired wet strength as above, the water-decomposable fibrous sheet of the invention may have a multi-layered structure. For example, a first fibrous sheet layer containing fibrillated rayon but not subjected to water-jetting treatment may underlie a second fibrous sheet layer containing fibrillated rayon and having been subjected to water-jetting treatment to give one water-decomposable fibrous sheet. The sheet having the two-layered structure could be more bulky and could have an increased wet strength without lowering its decomposability in water. One first fibrous sheet layer may be sandwiched between two second fibrous sheet layers to give one water-decomposable fibrous sheet having a three-layered laminate structure.

The water-decomposable fibrous sheet of the invention may optionally contain any other substances, without interfering with the advantages of the invention. For example, it may contain any of surfactants, microbicides, preservatives, deodorants, moisturizers, alcohols such as ethanol, polyalcohols such as glycerin, etc.

As having good decomposability in water and high wet strength, the water-decomposable fibrous sheet of the invention is usable as wet tissue for application to the skin of human bodies including the private parts thereof, or as cleaning sheets for toilets and thereabouts. To enhance its wiping and cleaning capabilities for those applications, the sheet may previously contain water, surfactant, alcohol, glycerin and the like. Where the water-decomposable fibrous sheet of the invention is, while being previously wetted with liquid detergent and the like, packaged for public sale, it shall be airtightly packaged and put on the market so that it is not spontaneously dried. On the other hand, the water-decomposable fibrous sheet may be marketed in dry. The users who have bought the dry water-decomposable fibrous sheet may wet it with water or liquid chemicals before use.

Since the water-decomposable fibrous sheet of the invention has high dry strength, any binder or electrolyte may not be added thereto, being different from conventional water-decomposable fibrous sheets. Therefore, the sheet of the invention is highly safe for its application to the skin, and is usable as the sheet component of various water-decomposable absorbent articles including, for example, sanitary napkins, panty liners, sanitary tampons, disposable diapers, etc. For example, when the sheet is perforated, it may be used as the top sheet for water-decomposable absorbent articles. When the sheet is combined with any other fibers, it is usable as an absorbent layer, a cushion layer, a back sheet, etc.

The fibrous sheet of the invention may be embossed. Where the fibrous sheet is embossed under heating after adding a small amount of water thereto, the strength of the hydrogen bonding between fibers of the fibrillated rayon (and between the fibrillated rayon fibers and the other fibers if contained) will be increased. Therefore, the fibrous sheet after embossing will have a high dry strength. The fibrous sheet of this type is more suitable for use as a wiper or for use as a sheet component constituting an absorbent article.

EXAMPLES

The invention is described in more detail with reference to the following Examples, which, however, are not intended to restrict the scope of the invention.

Example A:

Rayon fibers (from Acordis Japan) having a length of 4 mm were fibrillated in a mixer to prepare various types of fibrillated rayon having different degrees of beating as in Table 2 below. The fibrillated rayon was combined with ordinary non-fibrillated rayon (1.7 dtex (1.5 d), fiber length 5 mm) and bleached soft-wood kraft pulp (NBKP) (Canadian Standard Freeness, CSF=610 cc) and formed into a fibrous web according to a wet paper-making process for which was used a cylinder paper-making machine. In this step, the blend ratio of the fibers was varied in each Example. The fiber length of fibrillated rayon in Tables is meant to indicate the length of rayon fibers before beating treatment.

Without being dried but still on the plastic wire, the resulting fibrous web put on a running conveyor. While being moved at the speed indicated in Table 2, the fibrous web was subjected to water-jetting treatment under the condition also indicated in Table 2, whereby the fibers constituting it were entangled. The high-pressure water-jetting device used for the treatment was equipped with 2000 nozzles/meter each having an orifice diameter of 95 microns, at intervals of 0.5 mm between the adjacent nozzles, and the pressure of jetting water streams applied to the web was 40 kgf/cm$^2$ as in Table 2. In that condition, jetting water was applied to one surface of the web so that it passes through its back surface. The water-jetting treatment was repeated once again under the same condition. Next, this was dried with a Yankee drier to obtain a water-decomposable fibrous sheet of non-woven fabric. This was then wetted with 250 g, relative to 100 g of the mass of the non-woven fabric, of water. The thus-obtained water-decomposable fibrous sheet was tested for its degree of decomposition in water and its wet strength, according to the methods mentioned below.

The test for the decomposability in water was based on the test of JIS P-4501 indicating the degree of degradability of toilet paper. Precisely, a piece of the water-decomposable fibrous sheet having a length of 10 cm and a width of 10 cm was put into a 300-ml beaker filled with 300 ml of ion-exchanged water, and stirred therein with a rotor. The revolution speed of the rotor was 600 rpm. The condition of the test piece being dispersed in water was macroscopically observed, and the time until the test piece was finely dispersed was measured (see the following Table—the data are expressed in seconds).

The wet strength was measured according to the test method stipulated in JIS P-8135. Briefly, a piece of the fibrous sheet having a width of 25 mm and a length of 150 mm was tested both in the machine direction (MD) and in the cross direction (CD), by the use of a Tensilon tester, for which the chuck distance was 100 mm and the stress rate was 100 mm/min. The strength at break (gf) of the test piece thus measured indicates the wet strength thereof (see the following Table—the data are expressed in g/25 mm). The root of the product of the data in MD and the data in CD was obtained, indicating the mean value of the wet strength of the sample.

The fibrous sheets of Comparative Examples 1 and 2 were prepared in the same manner as in Example A, except that the fibrillated rayon was not used.

TABLE 2

| | Example A-1 | Example A-2 | Example A-3 | Comp. Example 1 | Comp. Example 2 |
|---|---|---|---|---|---|
| Fibrillated Rayon (1.5 d) | | | | | |
| Fiber Length | 4 mm | 4 mm | 4 mm | 4 mm | 4 mm |
| Degree of Beating | 600 cc | 600 cc | 600 cc | 600 cc | 600 cc |
| Blend Ratio | | | | | |
| Fibrillated Rayon | 5% | 30% | 70% | 0% | 0% |
| Rayon (1.5 d × 5 mm) | 30% | 30% | 30% | 30% | 70% |
| NBKP (degree of beating; 610 cc) | 65% | 40% | 0% | 70% | 30% |

TABLE 2-continued

| | Example A-1 | Example A-2 | Example A-3 | Comp. Example 1 | Comp. Example 2 |
|---|---|---|---|---|---|
| Condition for Water-Jetting Treatment | | | | | |
| Pressure | 40 kgf/cm$^2$ | 40 kgf/cm$^2$ | 40 kgf/cm$^2$ | 40 kgf/cm$^2$ | 40 kgf/cm$^2$ |
| Number of Repetitions | 2 | 2 | 2 | 2 | 2 |
| Speed | 50 m/min | 50 m/min | 50 m/min | 50 m/min | 50 m/min |
| Basis Weight (g/m$^2$) | 45.0 | 45.0 | 45.0 | 45.0 | 45.0 |
| Wet Strength (g/25 mm) | | | | | |
| MD | 136 | 163 | 235 | 95 | 130 |
| CD | 130 | 149 | 208 | 87 | 115 |
| √(CD × MD) | 133 | 156 | 221 | 91 | 122 |
| Decomposition in Water (seconds) | 95 | 85 | 105 | 95 | 180 |

From Table 2, it is seen that fibrillated rayon incorporated into the water-decomposable fibrous sheets enhanced the wet strength of the sheets, as compared with the sheets not containing it, without detracting from the decomposability thereof in water. This is because the entanglement owing to the presence of the microfibers of the fibrillated rayon enhanced the wet strength of the sheets, and in addition, the entanglement of the microfibers was readily untied to separate the fibers from each other when the sheets were put in a large amount of water. From the data of A-3, it is understood that the water-decomposable fibrous sheet has good decomposability in water and high wet strength, even not containing NBKP.

Example B:

Water-decomposable fibrous sheets were prepared in the same manner as in Example A. In this Example B, however, used were different types of fibrillated rayon each having different degrees of beating, as in Table 3 below. The fibrous sheets were tested in the same manner as above for their decomposability in water and their wet strength.

The data obtained are given in Table 3.

TABLE 3

| | Example B-1 | Example B-2 | Example B-3 | Example B-4 |
|---|---|---|---|---|
| Fibrillated Rayon (1.5 d) | | | | |
| Fiber Length | 4 mm | 4 mm | 4 mm | 4 mm |
| Degree of Beating | 700 cc | 500 cc | 300 cc | 200 cc |
| Blend Ratio | | | | |
| Fibrillated Rayon | 10% | 10% | 10% | 10% |
| Rayon (1.5 d × 5 mm) | 30% | 30% | 30% | 30% |
| NBKP (degree of beating; 610 cc) | 60% | 60% | 60% | 60% |
| Condition for Water-Jetting Treatment | | | | |
| Pressure | 40 kgf/cm$^2$ | 40 kgf/cm$^2$ | 40 kgf/cm$^2$ | 40 kgf/cm$^2$ |
| Number of Repetitions | 2 | 2 | 2 | 2 |
| Speed | 50 m/min | 50 m/min | 50 m/min | 50 m/min |
| Basis Weight (g/m$^2$) | 45.0 | 45.0 | 45.0 | 35.0 |
| Wet Strength (g/25 mm) | | | | |
| MD | 145 | 155 | 188 | 165 |
| CD | 135 | 149 | 165 | 151 |
| √(CD × MD) | 140 | 152 | 176 | 158 |
| Decomposition in Water (seconds) | 75 | 82 | 96 | 91 |

Example C:

Water-decomposable fibrous sheets were prepared in the same manner as in Example A. In this Example C, however, in preparation for fibrillated rayon, used were different types of rayon having different fiber lengths as in Table 4 below. The fibrous sheets of non-woven fabrics were tested in the same manner as above for their decomposability in water and their wet strength.

A comparative sample of a non-woven fabric was prepared in the same manner as in Example C. For this, however, in preparation for fibrillated rayon, used was rayon having a length of 12 mm. This was tested in the same manner as above.

The data obtained are given in Table 4.

TABLE 4

| | Example C-1 | Example C-2 | Example C-3 | Example C-4 | Comp. Example |
|---|---|---|---|---|---|
| Fibrillated Rayon (1.5 d) | | | | | |
| Fiber Length | 2 mm | 4 mm | 6 mm | 10 mm | 12 mm |
| Degree of Beating | 600 cc | 600 cc | 600 cc | 600 cc | 600 cc |
| Blend Ratio | | | | | |
| Fibrillated Rayon | 20% | 20% | 20% | 20% | 20% |
| Rayon (1.5 d × 5 mm) | 30% | 30% | 30% | 30% | 30% |
| NBKP (degree of beating; 610 cc) | 50% | 50% | 50% | 50% | 50% |
| Condition for Water-Jetting Treatment | | | | | |
| Pressure | 40 kgf/cm$^2$ | 40 kgf/cm$^2$ | 40 kgf/cm$^2$ | 40 kgf/cm$^2$ | 40 kgf/cm$^2$ |
| Number of Repetitions | 2 | 2 | 2 | 2 | 2 |
| Speed | 50 m/min | 50 m/min | 50 m/min | 50 m/min | 50 m/min |
| Basis Weight (g/m$^2$) | 45.0 | 45.0 | 45.0 | 45.0 | 45.0 |
| Wet Strength (g/25 mm) | | | | | |
| MD | 145 | 188 | 218 | 274 | 309 |
| CD | 135 | 171 | 193 | 241 | 289 |
| √(CD × MD) | 140 | 179 | 205 | 257 | 299 |
| Decomposition in Water (seconds) | 60 | 71 | 98 | 148 | 600< |

From the data of the comparative sample, it is understood that the decomposability in water of the fibrous sheet containing fibrillated rayon prepared from the rayon having a fiber length of 12 mm, or that is, over 10 mm is extremely poor, since the fibers in the sheet were entangled too much. As opposed to this, the decomposability in water of the fibrous sheet of Example C-4, in which the rayon used have a length of 10 mm, is still good. As in Example C-4 where the primary fibers of the fibrillated rayon used are long, the fibrous sheet could have well-balanced strength and decomposability in water so far as the fibrillated rayon to be used is not beaten too much (so that it could have a large numerical value indicating its degree of beating) and its blend ratio in preparing the sheet is reduced.

Example D:

Water-decomposable fibrous sheets were prepared in the same manner as in Example A. In this Example D, however, in preparation for fibrillated rayon, the rayon used had a fiber length of 3 mm and the blend ratio of the fibers used was varied as in Table 5. In addition, in this, the pressure of water in the water-jetting treatment was varied as in Table 5. The fibrous sheets were tested in the same manner as above for their decomposability in water and their wet strength.

The data obtained are given in Table 5.

TABLE 5

| | Ex. D-1 | Ex. D-2 | Ex. D-3 | Ex. D-4 | Ex. D-5 | Ex. D-6 | Ex. D-7 |
|---|---|---|---|---|---|---|---|
| Fibrillated Rayon (1.5 d) | | | | | | | |
| Fiber Length | 3 mm | 3 mm | 3 mm | 3 mm | 3 mm | 3 mm | 3 mm |
| Degree of Beating | 400 cc | 400 cc | 400 cc | 400 cc | 400 cc | 400 cc | 400 cc |
| Blend Ratio | | | | | | | |
| Fibrillated Rayon | 20% | 15% | 15% | 10% | 15% | 10% | 5% |
| Rayon (1.5 d × 5 mm) | 20% | 25% | 20% | 25% | 15% | 20% | 25% |
| NBKP (degree of beating; 610 cc) | 60% | 60% | 65% | 65% | 70% | 70% | 70% |
| Condition for Water-Jetting Treatment | | | | | | | |
| Pressure | 30 kgf/cm$^2$ | 30 kgf/cm$^2$ | 30 kgf/cm$^2$ | 30 kgf/cm$^2$ | 30 kgf/cm$^2$ | 30 kgf/cm$^2$ | 30 kgf/cm$^2$ |
| Number of Repetitions | 2 | 2 | 2 | 2 | 2 | 2 | 2 |
| Speed | 30 m/min | 30 m/min | 30 m/min | 30 m/min | 30 m/min | 30 m/min | 30 m/min |
| Basis Weight (g/m$^2$) | 50.0 | 50.0 | 50.0 | 50.0 | 50.0 | 50.0 | 50.0 |
| Wet Strength (g/25 mm) | | | | | | | |
| MD | 210 | 198 | 172 | 161 | 168 | 151 | 140 |
| CD | 190 | 171 | 165 | 155 | 150 | 146 | 138 |
| √(CD × MD) | 200 | 184 | 168 | 158 | 159 | 148 | 139 |
| Decomposition in Water (seconds) | 110 | 96 | 88 | 82 | 90 | 78 | 63 |

Example E:

Water-decomposable fibrous sheets were prepared in the same manner as in Example A. The sheets were composed of 10% by mass of fibrillated rayon (1.7 dtex; fiber length of starting rayon, 5 mm; degree of beating, 600 cc), 30% by mass of rayon (1.1 dtex; fiber length, 5 mm) and 60% by mass of NBKP used in Example A. For the sheets of Examples E-1 to E-4, the fibrillated rayon was prepared by beating the starting rayon in wet, for which were used different beating machines. The water-jetting treatment was effected twice, under a pressure of 30 kgf/cm$^2$ at a processing speed of 30 m/min. In wet and in dry, the fibrous sheets were tested for their strength and decomposability in water in the same manner as above. In addition, their breaking length was obtained in the manner mentioned below.

The breaking length was measured according to the test method for the tensile strength of paper and paperboards stipulated in JIS P-8113. Concretely, the breaking length is represented by the following formula:

Breaking Length (km)

=[tensile strength (kgf)]×1000/[(width of test piece, 25 mm)×(basis weight of test piece, g/m$^2$)]

In Comparative Examples, the same starting rayon (1.7 dtex; fiber length, 5 mm) as that for the samples of Examples E-1 to E-4 was free-beaten, and the free-beaten rayon was used in place of the wet-beaten, fibrillated rayon in Examples, to prepare comparative non-woven fabrics.

The data obtained are given in Table 6.

As in Table 6, it is understood that using the wet-beaten, fibrillated rayon as in the Examples of the invention, but not the free-beaten rayon as in the Comparative Examples, give water-decomposable fibrous sheets having higher wet strength, especially in the CD direction, though the degree of decomposition in water of the sheets is not so different from that of the sheets in the Comparative Examples.

Example F:

Water-decomposable fibrous sheets were prepared in the same manner as in Example A. In this Example F, however, used were different types of starting rayon having different lengths, and the blend ratio of the fibrillated rayon used was varied, as in Table 7. The water-jetting treatment was effected twice, under a pressure of 30 kgf/cm at a speed of 30 m/min. In wet and in dry, the fibrous sheets of non-woven fabrics were tested for their strength and decomposability in water in the same manner as above. In addition, their fastness to rubbing was measured in the manner mentioned below.

The fastness to rubbing was measured according to the test method for the abrasion resistance of paperboards as stipulated in JIS P-8136. However, in this measurement, a piece of artificial leather was attached to the circular arc area of the rubbing means A, while the sample was attached onto the sliding platform; and the sample was rubbed under a load of 500 g applied thereto with the sliding platform reciprocated.

TABLE 6

| | | | | Comp. Ex. 1 | Comp. Ex. 2 | E-1 | E-2 | E-3 | E-4 |
|---|---|---|---|---|---|---|---|---|---|
| | | | | free beating | | wet beating | | | |
| Mode of Beating Rayon | | | | beater | beater | mixer | pulper | refiner | refiner |
| Basis Weight | | | g/m$^2$ | 45.7 | 40.9 | 41.3 | 43.1 | 39.3 | 42.1 |
| Thickness | | | mm | 0.45 | 0.45 | 0.42 | 0.45 | 0.415 | 0.435 |
| Dry | strength | MD | g/25 mm | 1299 | 969 | 1529 | 1461 | 1407 | 1377 |
| | breaking length | | mm | 1137 | 948 | 1481 | 1356 | 1432 | 1308 |
| | strength | CD | g/25 mm | 915 | 778 | 1199 | 1167 | 1018 | 1148 |
| | breaking length | | mm | 801 | 761 | 1161 | 1083 | 1036 | 1091 |
| | decomposition in water | | sec | 85 | 69 | 78 | 83 | 62 | 93 |
| Wet | strength | MD | g/25 mm | 126 | 118 | 164 | 143 | 122 | 148 |
| | breaking length | | mm | 110 | 115 | 159 | 133 | 124 | 141 |
| | strength | CD | g/25 mm | 129 | 110 | 157 | 156 | 150 | 160 |
| | breaking length | | mm | 113 | 108 | 152 | 145 | 153 | 152 |
| | decomposition in water | | sec | 88 | 68 | 118 | 120 | 95 | 160 |

The data obtained are given in Table 7.

TABLE 7

| | | | F-1 | F-2 | F-3 | F-4 | F-5 | F-6 |
|---|---|---|---|---|---|---|---|---|
| NBKP (beaten) | | | 60% | 20% | 60% | 20% | 60% | 20% |
| Fibrillated Rayon (1.7 dtex; degree of beating, 400 cc) | | 3 mm | 40% | 80% | | | | |
| | | 5 mm | | | 40% | 80% | | |
| | | 7 mm | | | | | 40% | 80% |
| Rayon (1.1 dtex × 5 mm) | | | | | | | | |
| WJ Pressure | | kgf, twice | 30 | 30 | 30 | 30 | 30 | 30 |
| WJ Speed | | m/min | 30 | 30 | 30 | 30 | 30 | 30 |
| Basis Weight | | g/m$^2$ | 45.1 | 39.8 | 42.7 | 42.7 | 44.4 | 44.2 |
| Thickness | | mm | 0.456 | 0.322 | 0.418 | 0.322 | 0.391 | 0.341 |
| Dry Strength | MD | g/25 mm | 1085 | 1366 | 1343 | 1540 | 1436 | 1655 |

TABLE 7-continued

| | | | F-1 | F-2 | F-3 | F-4 | F-5 | F-6 |
|---|---|---|---|---|---|---|---|---|
| Dry Strength | CD | g/25 mm | 951 | 1419 | 1314 | 1604 | 1387 | 1689 |
| Wet Strength | MD | g/25 mm | 142 | 341 | 307 | 565 | 438 | 678 |
| Wet Strength | CD | g/25 mm | 128 | 275 | 272 | 493 | 312 | 686 |
| Decomposition of Dry Sheet in Water | | sec | 59 | 62 | 107 | 110 | >300 | >300 |
| Decomposition of Wet Sheet in Water | | sec | 64 | 64 | 123 | 168 | >300 | >300 |
| Fastness to Rubbing | MD | number of repetitions | 12 | — | 19 | — | 24 | — |
| Fastness to Rubbing | CD | number of repetitions | 12 | — | 20 | — | 10 | — |

As in F-1 and F-2, it is understood that, even though the starting fibers for the fibrillated rayon therein have a length of 3 mm, the non-woven fabrics have relatively high strength and their decomposition in water is good. The non-woven fabrics of that type could have higher strength while keeping good decomposability in water when the amount of the fibrillated rayon therein is larger. On the other hand, as in F-5 and F-6, it is difficult for the fibrous sheets of non-woven fabrics to have well-balanced decomposability in water and wet strength, when the starting fibers for the fibrillated rayon therein have a length of 7 mm, and, as a result, the decomposability in water of the sheets is lowered in some degree. Accordingly, using fibrillated rayon of which the starting fibers have a length of at most 6 mm gives fibrous sheets having well-balanced decomposability in water and wet strength. However, for the fibrillated rayon of which the starting fibers have a length of 7 mm or more, the fibrous sheets containing it could have well-balanced decomposability in water and wet strength, so far as the amount of the fibrillated rayon therein is reduced and the basis weight of the fibrous sheets is reduced.

Example G:

Water-decomposable fibrous sheets were prepared in the same manner as in Example A. In this Example G, however, used were different types of fibrillated rayon having different degrees of beating, as in Table 8 below. The water-jetting treatment was effected twice, under a pressure of 30 kgf/cm$^2$ at a speed of 30 m/min. The fibrous sheets of non-woven fabrics were tested in the same manner as above.

In addition, the fibrous sheets were tested for the KES flexural strength. In the KES flexure WARP (B/2HB), the KES flexure WEFT (B/2HB), the KES surface WARP (MIU/MMD), and the KES surface WEFT (MIU/MMD), WARP is the same as MD and WEFT is as CD. The value B indicates the flexural toughness, and the sheets having a larger value B are less flexible. (The data of the value B are expressed in g-cm$^2$/cm.) The value 2HB indicates the flexural hysteresis, and the sheets having a larger value 2HB are less restorable. (The data of the value 2HB are expressed in g-cm/cm.) MIU indicates the friction coefficient; and the larger the value MIU is, the poorer the smoothness on the sheet surfaces is. MMD indicates the friction coefficient fluctuation; and the larger the value MMD is, the poorer the degree of smoothness is.

The data obtained are given in Table 8.

TABLE 8

| | | | G-1 | G-2 | G-3 | G-4 |
|---|---|---|---|---|---|---|
| NBKP (beaten) | | | 50% | 50% | 50% | 50% |
| Fibrillated Rayon (1.7 dtex × 5 mm) | | | | | | |
| degree of beating, 600 cc | | | 10% | | | |
| degree of beating, 400 cc | | | | 10% | | |
| degree of beating, 200 cc | | | | | 10% | |
| degree of beating, 100 cc | | | | | | 10% |
| Rayon (1.7 dtex × 5 mm) | | | 40% | 40% | 40% | 40% |
| Basis Weight | | g/m$^2$ | 42.9 | 42.1 | 43.4 | 43.8 |
| Absolute Dry Basis Weight | | g/m$^2$ | 41.1 | 40.0 | 40.3 | 40.3 |
| Thickness | | mm | 0.438 | 0.390 | 0.402 | 0.377 |
| Dry Strength | MD | g/25 mm | 974 | 1146 | 1308 | 1380 |
| Dry Strength | CD | g/25 mm | 870 | 1011 | 1128 | 1136 |
| Wet Strength | MD | g/25 mm | 121 | 159 | 194 | 222 |
| Wet Strength | CD | g/25 mm | 118 | 151 | 198 | 220 |
| Absolute Wet Strength | | | 119.49 | 154.95 | 195.99 | 221.00 |
| Decomposition in Water of Dry Sheet | | sec | 76 | 71 | 66 | 79 |
| Decomposition in Water of Wet Sheet | | sec | 93 | 97 | 87 | 81 |
| KES Flexure WARP | B | g · cm/cm | 0.374 | 0.440 | 0.502 | 0.503 |
| | 2HB | g · cm$^2$/cm | 0.676 | 1.074 | 1.074 | 1.109 |
| KES Flexure WEFT | B | g · cm/cm | 0.257 | 0.300 | 0.244 | 0.294 |
| | 2HB | g · cm$^2$/cm | 0.405 | 0.354 | 0.253 | 0.489 |
| KES Surface WARP | MIU | | 0.140 | 0.195 | 0.154 | 0.153 |
| | MMD | | 0.125 | 0.131 | 0.130 | 0.125 |

TABLE 8-continued

| | | G-1 | G-2 | G-3 | G-4 |
|---|---|---|---|---|---|
| KES Surface WEFT | MIU | 0.157 | 0.166 | 0.203 | 0.148 |
| | MMD | 1.020 | 0.695 | 0.907 | 1.075 |

From the data in Table 8, it is understood that the fibrous sheets produced in Examples all have good decomposability in water and high wet strength. In particular, it is seen that the sheets of G-4 and G-5 are good.

Figure 11:
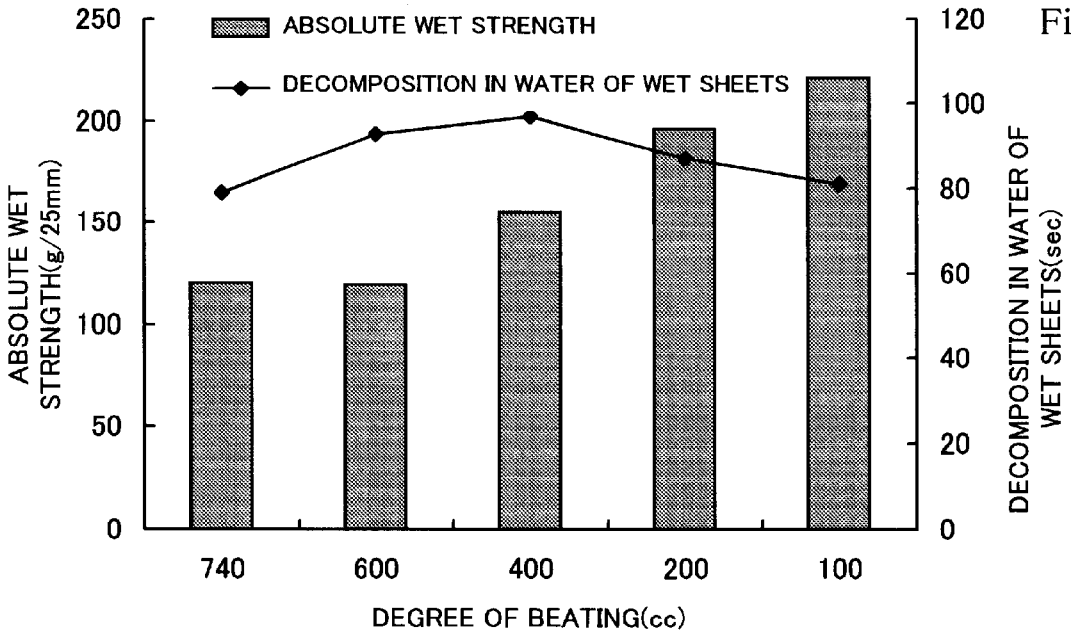
FIG. 11 is a graph showing the relationship between the wet strength of the sheets prepared in Example H and the degree of decomposition thereof in water, relative to varying degrees of beating rayon to give fibrillated rayon for the sheets.

The data of the absolute wet strength and the decomposability in water of wet samples given in Table 8 are plotted relative to the varying degrees of beating of the fibrillated rayon used, as in FIG. 11 showing the graph of the data. From FIG. 11, it is seen that the wet strength of the samples was higher, when the rayon to be the fibrillated rayon was beaten more (that is, the fibrillated rayon used had a smaller numerical value indicating the degree of beating). However, with reference to the degree of decomposition in water of the samples prepared herein, it is seen that the samples in which the fibrillated rayon used was beaten more to have a numerical value indicating the degree of beating of smaller than 400 cc have a higher wet strength but have a lower degree of decomposition in water. Accordingly, it is understood that the water-decomposable fibrous sheets of the invention have the advantage of augmenting both the decomposability in water and the wet strength, though the two properties, decomposability in water and wet strength of the sheets would be seemingly contradictory to each other.

Example H:

Water-decomposable fibrous sheets were prepared in the same manner as in Example G, and tested for their properties in the same manner as above.

Apart from those, comparative fibrous sheets were prepared for Comparative Examples 1 to 3. Precisely, in Comparative Example 1, used was rayon having a degree of beating of 740 cc and the fibrous sheet was prepared in the same manner as in Example G; and in Comparative Examples 2 and 3, fibrillated rayon was not used. In those Comparative Examples 2 and 3, the fibrous webs were subjected to water-jetting treatment twice under a pressure of 44 kgf/cm$^2$ at a processing speed of 15 m/min. The comparative fibrous sheets were also tested for their properties. The data obtained are given in Table 9 below.

TABLE 9

| | | | Com. Ex. 1 | H-1 | H-2 | H-3 | H-4 | Com. Ex. 2 | Com. Ex. 3 |
|---|---|---|---|---|---|---|---|---|---|
| NBKP (beaten) | | | 20% | 20% | 20% | 20% | 20% | 60% | 30% |
| Fibrillated Rayon (1.7 dtex × 5 mm) | | | | | | | | | |
| degree of beating, 740 cc | | | 80% | | | | | | |
| degree of beating, 600 cc | | | | 80% | | | | | |
| degree of beating, 400 cc | | | | | 80% | | | | |
| degree of beating, 200 cc | | | | | | 80% | | | |
| degree of beating, 100 cc | | | | | | | 80% | | |
| Rayon (1.7 dtex × 5 mm) | | | | | | | | 40% | 70% |
| Basis Weight | | g/m$^2$ | 42.8 | 42.5 | 44.4 | 42.0 | 40.5 | 43.4 | 46.5 |
| Thickness | | mm | 0.477 | 0.372 | 0.387 | 0.322 | 0.287 | 0.556 | 0.661 |
| Dry Strength | MD | g/25 mm | 377 | 882 | 1493 | 1624 | 1611 | 957 | 515 |
| Dry Strength | CD | g/25 mm | 370 | 1061 | 1500 | 1883 | 1603 | 672 | 446 |
| Wet Strength | MD | g/25 mm | 157 | 176 | 508 | 540 | 612 | 139 | 154 |
| Wet Strength | CD | g/25 mm | 66 | 215 | 509 | 491 | 487 | 101 | 133 |
| Absolute Wet Strength | | g/25 mm | 102 | 195 | 508 | 515 | 546 | 118 | 143 |
| Decomposition in Water of Dry Sheets | | sec | >300 | >300 | >300 | 104 | 107 | 122 | 144 |
| Decomposition in Water of Wet Sheets | | sec | >300 | >300 | >300 | 175 | 141 | 128 | 204 |
| KES Flexure WARP | B | g · cm/cm | 0.170 | 0.423 | 0.702 | 0.463 | 0.406 | — | — |
| | 2HB | g · cm$^2$/cm | 0.167 | 0.762 | 1.372 | 0.817 | 0.608 | — | — |
| KES Flexure WEFT | B | g · cm/cm | 0.112 | 0.350 | 0.326 | 0.354 | 0.309 | — | — |
| | 2HB | g · cm$^2$/cm | 0.0966 | 0.447 | 0.578 | 0.579 | 0.393 | — | — |
| KES Surface WARP | MIU | | 0.156 | 0.146 | 0.179 | 0.164 | 0.151 | — | — |
| | MMD | | 0.0115 | 0.0151 | 0.0134 | 0.0146 | 0.0113 | — | — |
| KES Surface WEFT | MIU | | 0.160 | 0.170 | 0.158 | 0.154 | 0.158 | — | — |
| | MMD | | 0.0765 | 0.0997 | 0.121 | 0.0992 | 0.0611 | — | — |
| Fastness to Rubbing | MD | number of repetitions | 11 | 7 | 19 | 28 | 14 | 8 | 12 |
| Fastness to Rubbing | CD | number of repetitions | 11 | 7 | 9 | 16 | 13 | 7 | 9 |

As in Table 9, it is understood that the fibrous sheets containing a larger amount of fibrillated rayon not beaten so much (to have a larger numerical value indicating the degree of beating) have a lower degree of decomposition in water. In Example K the samples H-3 and H-4 have well-balanced decomposability in water and wet strength. Therefore, when a larger amount (for example, at least 80% by mass) of fibrillated rayon is to be in the fibrous sheets, it is desirable to use fibrillated rayon having a degree of beating of at most 200 cc.

Example I:

Water-decomposable fibrous sheets were prepared in the same manner as in Example G. In this Example I, however, the amount of the fibrillated rayon added to the sheets varies, as in Table 10 below. In addition, in this Example I, rayon (non-fibrillated rayon) was not added to the sheets. The fibrous sheets of non-woven fabrics were tested for their properties in the same manner as above.

The comparative fibrous sheet (Comparative Example) was prepared in the same manner as in Example G to contain 3% by mass of fibrillated rayon.

The data obtained are given in Table 10.

TABLE 10

| | | | Comp. Ex. | I-1 | I-2 | I-3 | I-4 | I-5 |
|---|---|---|---|---|---|---|---|---|
| NBKP (beaten) | | | 97% | 95% | 93% | 10% | 5% | 0% |
| Fibrillated Rayon (1.7 dtex × 5 mm; degree of beating, 200 cc) | | 3% | 5% | 7% | 90% | 95% | 100% | |
| Basis Weight | | $g/m^2$ | 42.4 | 41.9 | 42.6 | 45.5 | 44.1 | 43.0 |
| Thickness | | mm | 0.512 | 0.490 | 0.473 | 0.392 | 0.396 | 0.382 |
| Dry Strength | MD | g/25 mm | 1147 | 1172 | 1316 | 1932 | 1990 | 2185 |
| Dry Strength | CD | g/25 mm | 957 | 878 | 1029 | 1656 | 1631 | 1697 |
| Wet Strength | MD | g/25 mm | 67 | 84 | 97 | 590 | 617 | 663 |
| Wet Strength | CD | g/25 mm | 61 | 81 | 105 | 579 | 568 | 627 |
| Decomposition in Water of Dry Sheets | | sec | 69 | 66 | 79 | 71 | 73 | 57 |
| Decomposition in Water of Wet Sheets | | sec | 67 | 74 | 98 | 84 | 80 | 66 |

As in Table 10, the fibrous sheets containing at least 5% by mass, but preferably at least 7% by mass of fibrillated rayon have good decomposability in water and their wet strength is satisfactory to some degree. From the data obtained, in addition, it has been confirmed that the fibrous sheets of non-woven fabrics containing fibrillated rayon alone, but not containing non-fibrillated rayon, have a considerably high degree of decomposition in water, still having a considerably high strength. However, it is seen that, if the amount of fibrillated rayon added is too small, for example, the amount is 3% by mass, the wet strength of the fibrous sheet is considerably low.

Example J:

Water-decomposable fibrous sheets were prepared in the same manner as in Example G. In this Example J, however, the fineness of the fibrillated rayon added to the sheets varies, as in Table 11 below. The fibrous sheets of non-woven fabrics were tested for their properties in the same manner as above. For the measurement, n (number of samples tested)=3.

The data obtained are given in Table 11.

TABLE 11

| | | J-1 | J-2 |
|---|---|---|---|
| NBKP (beaten) | | 20% | 20% |
| Fibrillated Rayon | 1.4 dtex | 80% | |
| (degree of beating, 200 cc) | 1.7 dtex | | 80% |
| Basis Weight | | 41.6 | 45 |
| Thickness | | 0.36 | 0.37 |

TABLE 11-continued

| | | | J-1 | J-2 |
|---|---|---|---|---|
| Dry Strength | MD | | 2064 | 1762 |
| | | | 2019 | 1586 |
| | | | 2156 | 1978 |
| | | AVE | 2080 | 1775 |
| | | Standard Deviation | 50.9 | 135.1 |
| | | Breaking Length (m) | 2000 | 1577 |
| | CD | | 1743 | 1809 |
| | | | 1663 | 1696 |
| | | | 1649 | 1761 |
| | | AVE | 1685 | 1755 |
| | | Standard Deviation | 38.7 | 39.6 |
| | | Breaking Length (m) | 1620 | 1560 |
| Wet Strength | MD | | 733 | 628 |
| | | | 607 | 527 |
| | | | 578 | 644 |
| | | AVE | 639 | 600 |
| | | Standard Deviation | 62.4 | 48.4 |
| | | Breaking Length (m) | 614 | 533 |
| | CD | | 629 | 609 |
| | | | 649 | 521 |
| | | | 514 | 586 |
| | | AVE | 597 | 572 |
| | | Standard Deviation | 55.6 | 34.0 |
| | | Breaking Length (m) | 574 | 508 |
| Decomposition in Water of Dry Sheets | | | 92 | 96 |
| Decomposition in Water of Wet Sheets | | | 107 | 98 |

As in Table 11, there is found little difference in the decomposability in water between J-1 and J-2. On the other hand, the samples of J-1, to which was added finer fibrillated rayon having a smaller fineness, have higher dry strength and higher wet strength. Accordingly, it is understood that using finer fibrillated rayon having a smaller fineness gives fibrous sheets having higher strength, without lowering the degree of decomposition in water of the sheets.

Example K:

Water-decomposable fibrous sheets were prepared in the same manner as in Example A. In this Example K, however, the fibrous sheets were made in a hand-papermaking method, and were not subjected to water-jetting treatment. The fibrous sheets were tested for their properties in the same manner as above. Since the sheets were made in a hand-papermaking method, there is no difference between the strength in MD and that in CD.

The data obtained are given in Table 12.

TABLE 12

| Sample No. | | K-1 | K-2 | K-3 |
|---|---|---|---|---|
| NBKP (beaten) | | 20% | 20% | 20% |
| Fibrillated Rayon (1.7 dtex × 5 mm) | degree of beating, 600 cc | 80% | | |
| | degree of beating, 400 cc | | 80% | |
| | degree of beating, 200 cc | | | 80% |
| Basis Weight | g/m$^2$ | 46.5 | 44.6 | 41.7 |
| Thickness | mm | 0.289 | 0.266 | 0.194 |
| Dry Strength | g/25 mm | 701 | 1050 | 1640 |
| Wet Strength | g/25 mm | 99 | 135 | 253 |
| Decomposition in Water of Dry Sheets | sec | >300 | 52 | 30 |
| Decomposition in Water of Wet Sheets | sec | >300 | 43 | 21 |
| Fastness to Rubbing | number of repetitions | 5 | 3 | 5 |

As in Table 12, the samples through K-1 to K-3 all have high dry strength, owing to the hydrogen bonding power of the microfibers of the fibrillated rayon. In addition, the samples of K-2 and K-3 have high wet strength and good decomposability in water. Presumably, such high wet strength is due to strong hydrogen boding and entanglement of the microfibers. Therefore, it is possible to obtain fibrous sheets having a high degree of decomposition in water and having high strength both in wet and dry even in a paper-making process not comprising a step of water-jetting treatment, so far as the fibrillated rayon used falls within the scope of the invention. However, when fibrillated rayon having been much beaten (therefore having a small numerical value indicating the degree of beating) is used in producing fibrous sheets, it is desirable that the amount of the fibrillated rayon to be added to the fibrous sheets is increased. The sample of K-1 has a low degree of decomposition in water. This is because the rayon not having been fibrillated much was used in the sample of K-1. Therefore, when fibrillated rayon having a degree of beating of 600 cc or so is used in producing fibrous sheets in a paper-making method, the amount of the fibrillated rayon to be added to the fibrous sheets is preferably reduced whereby the decomposability in water of the fibrous sheets produced could be increased further more.

In addition, the water-decomposable fibrous sheet not subjected to water jetting treatment may be combined with the water-decomposable fibrous sheet subjected to water-jetting treatment to form a laminate structure. Such a laminate sheet could bear wiping easily.

Example L:

Water-decomposable fibrous sheets were prepared in the same manner as in Example K. That is, the fibrous sheets were made in a hand-papermaking method, and were not subjected to water-jetting treatment. In this hand-papermaking method, used was a square-shape sheet machine, and the resulting square-shaped sheets were dried with a rotary dryer. For fibrillated rayon, solvent-spun cellulose fibers (1.7 dtex, fiber length 5 mm, from Acordis Japan) were fibrillated in a table mixer to have a degree of beating of 200 cc. Pulp was beaten in a refiner to have a degree of beating of 600 cc. For non-fibrillated rayon, rayon fibers (1.7 dtex, fiber length 5 mm) were used as they were. The basis weight of each sheet was 40 g/m$^2$. For the measurement of the fibrous sheets in wet, the fibrous sheets were infiltrated with 250 g, relative to 100 g of the mass of the fibrous sheets, of water, and then allowed to stand for 24 hours.

The tearing resistance in dry was measured according to JIS P-8116 such that the water-decomposable fibrous sheet thus prepared was cut into a piece having a width of 25 mm and a length of 150 mm; and it was tested by the use of a Tensilon tester, for which the chuck distance was 100 mm and the stress rate was 300 mm/min (see the following Table—the data are expressed in g).

Also, the degree of extension in wet was measured.

The data obtained are given in Table 13.

TABLE 13

| | Comparative Example | | | | | | Example | | | | |
|---|---|---|---|---|---|---|---|---|---|---|---|
| | 1 | 2 | 3 | 4 | 5 | | L-1 | L-2 | L-3 | L-4 | L-5 |
| NBKP | 100% | 70% | 50% | 30% | 0% | NBKP | 97% | 95% | 90% | 80% | 70% |
| Rayon | 0% | 30% | 50% | 70% | 100% | Fibrillated Rayon | 3% | 5% | 10% | 20% | 30% |
| Dry Strength (g/25 mm) | 2925 | 1918 | 1115 | 602 | — | Dry Strength (g/25 mm) | 3355 | 3635 | 3858 | 3159 | 2682 |
| Wet Strength (g/25 mm) | 60 | 83 | 66 | 45 | — | Wet Strength (g/25 mm) | 102 | 112 | 125 | 183 | 201 |
| Degree of Extension in Wet (%) | 1.2 | 3.68 | 4.38 | 7.76 | — | Degree of Extension in Wet (%) | 2.54 | 3.42 | 3.35 | 4.12 | 4.68 |
| Decomposition in Water (sec) | 27 | 21 | 11 | 9 | — | Decomposition in Water (sec) | 20 | 18 | 19 | 26 | 30 |
| Tearing Resistance in Dry (g) | 102 | 93 | 61 | 33 | — | Tearing Resistance in Dry (g) | 112 | 130 | 155 | 159 | 162 |

| | Example | | | | | | | |
|---|---|---|---|---|---|---|---|---|
| | L-6 | L-7 | l-8 | L-9 | L-10 | L-11 | L-12 | L-13 |
| NBKP | 50% | 30% | 20% | 10% | 0% | 80% | 70% | 50% |
| Fibrillated Rayon | 50% | 70% | 80% | 90% | 100% | 10% | 10% | 10% |
| Rayon | — | — | — | — | — | 10% | 20% | 40% |

TABLE 13-continued

| | | | | | | | | |
|---|---|---|---|---|---|---|---|---|
| Dry Strength (g/25 mm) | 2251 | 1791 | 1621 | 1499 | 1099 | 2586 | 2117 | 1388 |
| Wet Strength (g/25 mm) | 254 | 263 | 271 | 275 | 296 | 115 | 109 | 99 |
| Degree of Extension in Wet (%) | 6.29 | 7.73 | 8.29 | 8.11 | 7.89 | 3.77 | 4.41 | 5.32 |
| Decomposition in Water (sec) | 29 | 31 | 29 | 26 | 29 | 21 | 26 | 29 |
| Tearing Resistance in Dry (g) | 177 | 187 | 193 | 199 | 206 | 119 | 108 | 84 |

| | Example | | | | | | |
|---|---|---|---|---|---|---|---|
| | L-14 | L-15 | L-16 | L-17 | L-18 | L-19 | L-20 |
| NBKP | 30% | 10% | — | — | — | — | — |
| Fibrillated Rayon | 10% | 10% | 10% | 30% | 50% | 70% | 90% |
| Rayon | 60% | 80% | 90% | 70% | 50% | 30% | 10% |
| Dry Strength (g/25 mm) | 969 | 549 | 438 | 551 | 674 | 793 | 879 |
| Wet Strength (g/25 mm) | 83 | 67 | 54 | 106 | 163 | 207 | 236 |
| Degree of Extension in Wet (%) | 7.17 | 8.31 | 8.76 | 8.43 | 8.34 | 8.25 | 7.94 |
| Decomposition in Water (sec) | 27 | 31 | 32 | 33 | 31 | 32 | 31 |
| Tearing Resistance in Dry (g) | 76 | 66 | 51 | 83 | 118 | 147 | 164 |

As in Table 13, when the proportion of the non-fibrillated rayon was 100%, the fibers could not be bound together in the hand-papermaking method, and therefore it was impossible to form a fibrous sheet only from the non-fibrillated rayon. On the other hand, as in the sample L-10 according to the invention, the fibrous sheet could be formed in the hand-papermaking method even when the proportion of the fibrillated rayon was 100%. This fibrous sheet has a good decomposability in water and a high wet strength.

In addition, the samples according to the invention have a high degree of extension and a high tearing resistance. Therefore, it is seen that the fibrous sheet of the invention is excellent in durability when used for wiping.

Example M:

Water-decomposable fibrous sheets were prepared in the same manner as in Example L. In this Example M, however, the amount of water to be infiltrated into the sheets were varied among the samples.

The data obtained are given in Table 14.

TABLE 14

| | Rate of Impregnation of Water (relative to the self weight of Sample) | M-1 | M-2 | M-3 | M-4 | M-5 |
|---|---|---|---|---|---|---|
| NBKP | | 97% | 95% | 90% | 80% | 70% |
| Fibrillated Rayon | | 3% | 5% | 10% | 20% | 30% |
| Dry Strength (g/25 mm) | — | 3355 | 3635 | 3858 | 3159 | 2682 |
| Wet Strength (g/25 mm) | 100% | 296 | 247 | 367 | 537 | 565 |
| Degree of Extension in Wet (%) | 100% | 3.57 | 3.39 | 5.3 | 5.72 | 5.89 |
| Wet Strength (g/25 mm) | 250% | 102 | 112 | 125 | 183 | 201 |
| Degree of Extension in Wet (%) | 250% | 2.54 | 3.42 | 3.35 | 4.12 | 4.68 |

TABLE 14-continued

| | Rate of Impregnation of Water (relative to the self weight of Sample) | M-1 | M-2 | M-3 | M-4 | M-5 |
|---|---|---|---|---|---|---|
| Wet Strength (g/25 mm) | 320% | 48 | 52 | 60 | 89 | 102 |

As in Table 14, the water-decomposable fibrous sheet of the invention can procure a relatively high wet strength even when a large amount of water is contained.

As will be understood from the data given hereinabove, the water-decomposable fibrous sheets of the invention have good decomposability in water and high wet strength, as containing fibrillated rayon with microfibers formed around its primary fibers and therefore capable of taking the advantage of the microfibers entangled with fibers and/or their hydrogen bonding power. In addition, as will be also understood from the Examples, it is possible to make the water-decomposable fibrous sheets of the invention have well-balanced decomposability in water and wet strength by varying the fiber length and the fineness of the fibrillated rayon and other fibers to be in the sheets, the degree of beating in preparing the fibrillated rayon, the blend ratios of the fibrillated rayon and other fibers to be in the sheets, and the basis weight of the sheets. Moreover, when the fibrous sheet is used for wiping operation, because the microfibers of the fibrillated rayon come into contact with the surface to be wiped, the friction against the fibrous sheet will be low. Therefore, the fibrous sheet of the invention is excellent in durability.

When subjected to water-jetting treatment, the water-decomposable fibrous sheets of the invention could be more bulky to have a soft feel.

Even though not subjected to water-jetting treatment but prepared for example in a papermaking process, the fibrous sheets could have good decomposability in water and high wet and dry strength.

While the invention has been described in detail and with reference to specific embodiments thereof, it will be apparent to one skilled in the art that various changes and modifications can be made therein without departing from the spirit and scope thereof.

What is claimed is:

1. A water-decomposable fibrous sheet, comprising from 3 to 20% by mass of fibrillated rayon comprising primary fibers and microfibers extending therefrom, and a balance being non-fibrillated rayon and pulp having a length of at most 10 mm, wherein:

primary fibers have a length in a range of from 2.5 to 6.5 mm at a peak of mass distribution thereof; microfibers having a length of at most 1 mm account for from 0.1 to 50% by mass of a self-weight of the fibrillated rayon; and the microfibers are hydroentangled with each other or with other fibers.

2. The water-decomposable fibrous sheet as claimed in claim 1, wherein the primary fibers have a length of from 2.5 mm to less than 4.5 mm at a peak of mass distribution thereof.

3. The water-decomposable fibrous sheet as claimed in claim 2, wherein the microfibers having a length of at most 1 mm account for from 0.5 to 15% by mass of the self-weight of the fibrillated rayon.

4. The water-decomposable fibrous sheet as claimed in claim 1, of which the basis weight falls between 30 and 70 $g/m^2$.

5. The water-decomposable fibrous sheet as claimed in claim 1, which has a degree of decomposition in water of at most 200 seconds, as measured according to JIS P-4501.

6. The water-decomposable fibrous sheet as claimed in claim 1, which has a wet strength of at least 110 g/25 mm.

7. The water-decomposable fibrous sheet as claimed in claim 1, which has a dry strength of at least 350 g/25 mm.

8. The water-decomposable fibrous sheet as claimed in claim 1, which is a non-woven fabric having been subjected to water-jetting treatment.

9. The water-decomposable fibrous sheet as claimed in claim 1, wherein the fineness of the fibrillated rayon is from 1.2 to 1.9 dtex.

10. The water-decomposable fibrous sheet as claimed in claim 1, wherein the primary fibers have a length of 3±0.5 mm at a peak of mass distribution thereof, and the microfibers having a length of at most 1 mm account for from 0.1 to 10% by mass of the self-weight of the fibrillated rayon.

11. The water-decomposable fibrous sheet as claimed in claim 1, wherein the primary fibers have a length of 4±0.5 mm at a peak of mass distribution thereof, and the microfibers having a length of at most 1 mm account for from 1 to 14% by mass of the self-weight of the fibrillated rayon.

12. The water-decomposable fibrous sheet as claimed in claim 1, wherein the primary fibers have a length of 5±10.5 mm at a peak of mass distribution thereof, and the microfibers having a length of at most 1 mm account for from 0.3 to 45% by mass of the self-weight of the fibrillated rayon.

13. The water-decomposable fibrous sheet as claimed in claim 1, wherein the primary fibers have a length of 6±0.5 mm at a peak of mass distribution thereof, and the microfibers having a length of at most 1 mm account for from 5 to 50% by mass of the self-weight of the fibrillated rayon.

* * * * *